US007631389B2

(12) United States Patent
St. James et al.

(10) Patent No.: US 7,631,389 B2
(45) Date of Patent: Dec. 15, 2009

(54) HYDRAULICALLY ACTUATED HANDLE APPARATUS

(75) Inventors: Elliot St. James, British Columbia (CA); Melbourne Edmond St. James, British Columbia (CA); Tyson St. James, British Columbia (CA)

(73) Assignee: Columbia Taping Tools Ltd. (CA)

( * ) Notice: Subject to any disclaimer, the term of this patent is extended or adjusted under 35 U.S.C. 154(b) by 819 days.

(21) Appl. No.: 11/075,831

(22) Filed: Mar. 8, 2005

(65) Prior Publication Data

US 2005/0193511 A1 Sep. 8, 2005

Related U.S. Application Data

(60) Provisional application No. 60/550,311, filed on Mar. 8, 2004.

(51) Int. Cl.
*B25G 1/00* (2006.01)

(52) U.S. Cl. ..... 15/144.4; 15/144.1

(58) Field of Classification Search ..... 15/144.4, 15/144.1, 144.2, 235.8; 16/429, 900, 110.1, 16/436, 113.1, 405
See application file for complete search history.

(56) References Cited

U.S. PATENT DOCUMENTS

| | | | | |
|---|---|---|---|---|
| 3,090,984 | A | 5/1963 | Dunnigan | |
| 3,105,262 | A | 10/1963 | Lathrop et al. | |
| 4,326,316 | A * | 4/1982 | Dolenti | 15/246 |
| 4,592,797 | A | 6/1986 | Carlson | |
| 4,767,297 | A | 8/1988 | Mower et al. | |
| 5,062,731 | A | 11/1991 | MacMillan | |
| 5,088,147 | A | 2/1992 | MacMillan | |
| 5,099,539 | A | 3/1992 | Forester | |
| 5,182,965 | A | 2/1993 | MacMillan | |
| 5,622,729 | A | 4/1997 | Mower | |
| 6,260,238 | B1 | 7/2001 | MacMillan | |
| 6,367,121 | B1 | 4/2002 | MacMillan | |
| 6,412,138 | B1 | 7/2002 | MacMillan | |

FOREIGN PATENT DOCUMENTS

| | | |
|---|---|---|
| CA | 2031952 | 12/1990 |
| CA | 2035484 | 2/1991 |
| CA | 2035485 | 2/1991 |
| CA | 2057085 | 12/1991 |
| CA | 2376578 | 3/2002 |
| EP | 0 441 455 | 8/1991 |

OTHER PUBLICATIONS

Premier Handle in Construction Dimensions/Oct. 1994 Box Handle #9 at pp. 28-29.

* cited by examiner

*Primary Examiner*—Dung Van Nguyen
(74) *Attorney, Agent, or Firm*—Marger Johnson & McCollom, P.C.

(57) ABSTRACT

An apparatus includes a handle having a first end and a second end; an actuator attached to the handle; a tool plate for receiving a tool; a connector attached to the second end of the handle for pivotally connecting the handle to the tool plate; a hydraulic hose; and a hydraulically actuated brake assembly which is in communication with the actuator by the hydraulic hose. The brake assembly is preferably operable to releasably hold the tool plate at a position relative to the connector and the handle on operation of the actuator.

14 Claims, 19 Drawing Sheets

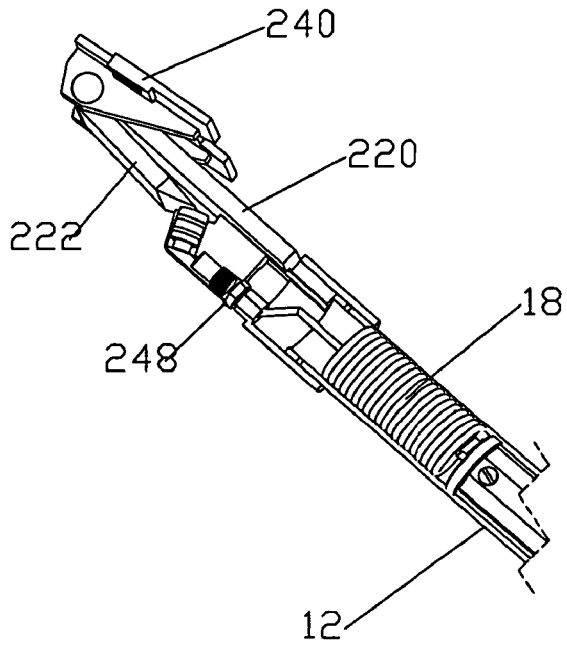
Figure 17
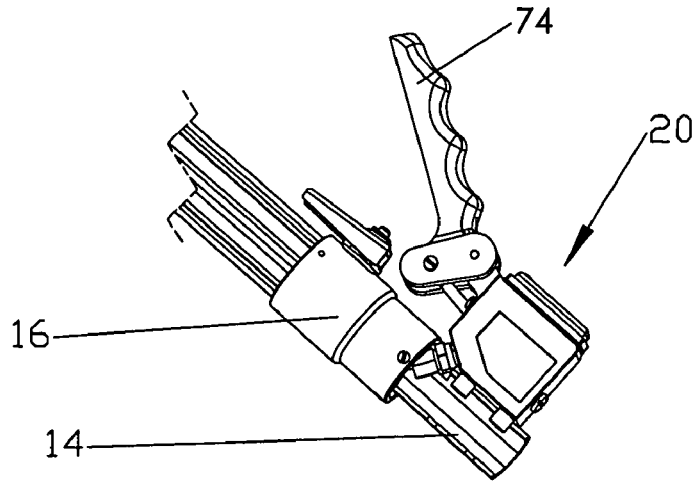

HYDRAULICALLY ACTUATED HANDLE APPARATUS

This application claims the benefit of U.S. Provisional Application Ser. No. 60/550,311, filed Mar. 8, 2004, the disclosure of which is incorporated herein in its entirety by reference.

BACKGROUND OF THE INVENTION

1. Field of Invention

The present invention relates generally to elongated tool handles and tools, and more particularly to tool handles and tools wherein the elongate tool handle can support a tool at one end and is actuated or controlled at or near the opposite end of the elongate handle.

2. Description of Related Art

Numerous tools having an elongate handle are well known. Furthermore, these tools often include a handle which is extendable thereby allowing a user to operate the tool from a distance. Numerous such handles and tools are described in U.S. Pat. Nos. 5,099,539; 5,088,147; 6,367,121; 6,260,238; 6,412,138; CA Patent 2,376,578; CA Patent 2,057,085; CA Patent 2,031,952; and CA Patent 2,035,484.

U.S. Pat. No. 5,099,539 and CA Patent 2,057,085 by Forrester and U.S. Pat. No. 5,088,147, CA Patent 2,031,952 and U.S. Pat. No. 6,260,238 by MacMillan all show adjustable length handles for flat finishers. These handles have a lever pivoted at one end and a box footplate pivoted at the other. In use a flat finishing box is attached to the footplate, the handle is adjusted to the needed length, and the handle is maneuvered to place the box against a work surface. This placement sets the box and footplate at an angle to the long axis of the handle and the lever is operated to lock the box and footplate at that angle relative to the handle. The mechanical complexity of these prior art adjustable length handles for flat finishers is typical in the prior art and increases maintenance costs of the handles and can compromise their reliability, thereby increasing operation costs. The lock mechanism in particular tends to be delicate relative to its performance requirements and range of angular motion of the box footplate is quite limited.

U.S. Pat. No. 6,412,138 provides an adjustable length handle for flat finishers. The primary structural components of the handle are two telescopic tubes. When the tubes are telescopically engaged each has an overlapped end and a free end. A box footplate is attached to the free end of the larger tube. The two axes of angular motion are perpendicular to each other and the axis of the handle. Angular motion of the box footplate about one axis is transmitted by bevel gearing to telescopic torque transmission mechanism in the handle. The length of the handle is manually adjustable and set at a particular length by a lever operated length lock assembly.

U.S. Pat. No. 6,367,121, CA Patent 2,376,578 (MacMillan) also shows an adjustable length handle for flat finishers, with the addition of a lever assembly that engages a tube in the locking mechanism, preventing it from moving longitudinally and the footplate from pivoting on the handle.

Many of these handles are designed to attach a variety of tools to one end, for example a flat finishing box, trowels for cement or plaster sanders, squeegees and other drywall tools. These tools are particularly useful in that they allow the user to extend their reach in order to control the tool from a distance without the need of scaffolding or ladders, and to operate the tool on a work surface outside of the user's normal reach.

The use of such tools greatly decreases the time required to complete work by eliminating the need to set up and move scaffolding or ladders. Furthermore, it allows a user the option of working from a floor surface and thereby avoid working from a potentially unsteady scaffolding or ladder, risking a fall and subsequent injury or avoid the need for having numerous handles of varying lengths. The majority of such handles are mechanically actuated and require a significant number of moving parts which are prone to wear and failure thereby decreasing the reliability of the tool handle and subsequently necessitating maintenance.

SUMMARY OF THE INVENTION

In accordance with one aspect of the invention, there is provided an apparatus including a handle having a first end and a second end; an actuator attached to the handle; a connector attached to the second end of the handle; a tool plate pivotally attached to the connector for receiving a tool; a hydraulic hose; and a hydraulically actuated brake assembly communicating with the actuator by the hydraulic hose. The brake assembly may be operable to releasably hold the tool plate at a position relative to the connector and the handle on operation of the actuator. The handle and the hydraulic hose may be extendable. The apparatus may further include an extension locking mechanism to secure the handle at a length as selected by a user. The brake assembly may further include a brake dial, attached to the tool plate; a hydraulic hose connector for attaching the hydraulic hose to the brake assembly; a ram housing, operably connected to the hydraulic hose connector; a ram, operably positioned within the ram housing, the ram may be pushed when the actuator is engaged; a brake pin, engageable by the ram, whereby the brake pin engages the brake dial to prevent pivotal movement of the tool plate. The apparatus may be dimensioned to support a flat finishing box. The hydraulic hose may be coiled. Furthermore, the hydraulic hose may be amenable to heat treatment so that the hydraulic hose may be shaped to fit the apparatus.

In accordance with another aspect of the invention, there is provided an apparatus including a handle, having a first end and a second end; an actuator, attached to at the first end of the handle; a connector attached to the second end of the handle for pivotally connecting the handle to a tool; a hydraulic hose; and a hydraulically actuated brake assembly operably connected to the actuator by the hydraulic hose. The brake assembly may be operable to releasably hold the tool at a position relative to the connector and the handle on operation of the actuator. The handle and the hydraulic hose may be extendable. The apparatus may further include an extension locking mechanism to releasably secure the handle at a selected length by a user. The brake assembly may further include a brake dial, operable to be attached the tool; a hydraulic hose connector for attaching the hydraulic hose to the brake assembly; a ram housing, operably connected to the hydraulic hose connector; a ram, operably positioned within the ram housing, the ram may be pushed when the actuator is engaged; a brake pin, engageable by the ram whereby the brake pin engages the brake dial to prevent pivotal movement of the tool. The apparatus may be dimensioned to support a flat finishing box. The hydraulic hose may be coiled. The hydraulic hose may be coiled. Furthermore, the hydraulic hose may be amenable to heat treatment so that the hydraulic hose may be shaped to fit the apparatus.

In accordance with another aspect of the invention, there is provided a kit for modifying a handle, wherein the handle has a first end and a second end and wherein the kit includes: an actuator attachable to the first end of the handle; a connector attachable to the second end of the handle; a tool plate pivotally attached to the connector for receiving a tool; a hydraulic hose; a hydraulically actuated brake assembly operable to communicate with the actuator by the hydraulic hose, wherein the brake assembly is operable to releasably hold the tool plate at a position relative to the connector and the handle on operation of the actuator; and optionally, instructions for use in modifying the handle.

In accordance with another aspect of the invention, there is provided a brake assembly including: a tool plate; a brake dial attached to the tool plate; a hydraulic hose connector for attaching a hydraulic hose to the brake assembly; a ram housing operably connected to the hydraulic hose connector; a ram operably positioned within the ram housing, wherein the ram is pushed when hydraulic pressure is transmitted along the hydraulic hose; and a brake pin, engagable by the ram, whereby the brake pin engages the brake dial to prevent pivotal movement of the tool plate.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention,

FIG. 6(*b*) is an exploded side view of a portion of the apparatus show in FIG. 1, showing the extension locking mechanism.

FIG. 9(*b*) is a detailed end view of the actuator ram, post and handle pressure adaptor isolated from the actuator apparatus shown in FIGS. 4 and 5.

FIG. 9(*c*) is a detailed side view of the actuator ram, post and handle pressure adaptor isolated from the actuator apparatus shown in FIGS. 4 and 5.

FIG. 17 is a perspective partial cross-sectional view of an assembled apparatus according to the second embodiment of the invention shown in FIG. 16, showing an alternative tool plate connector and brake assembly configuration attached to a handle and actuator.

FIG. 18(*b*) a partial cross-sectional side view of an alternate actuator assembly.

FIG. 19(*b*) is an exploded side view of the alternate extension locking mechanism shown in FIG. 19(*a*).

FIG. 19(*c*) is an exploded end view of the alternate extension locking mechanism shown in FIGS. 19(*a*) and 19(*b*).

DETAILED DESCRIPTION

Figure 1:
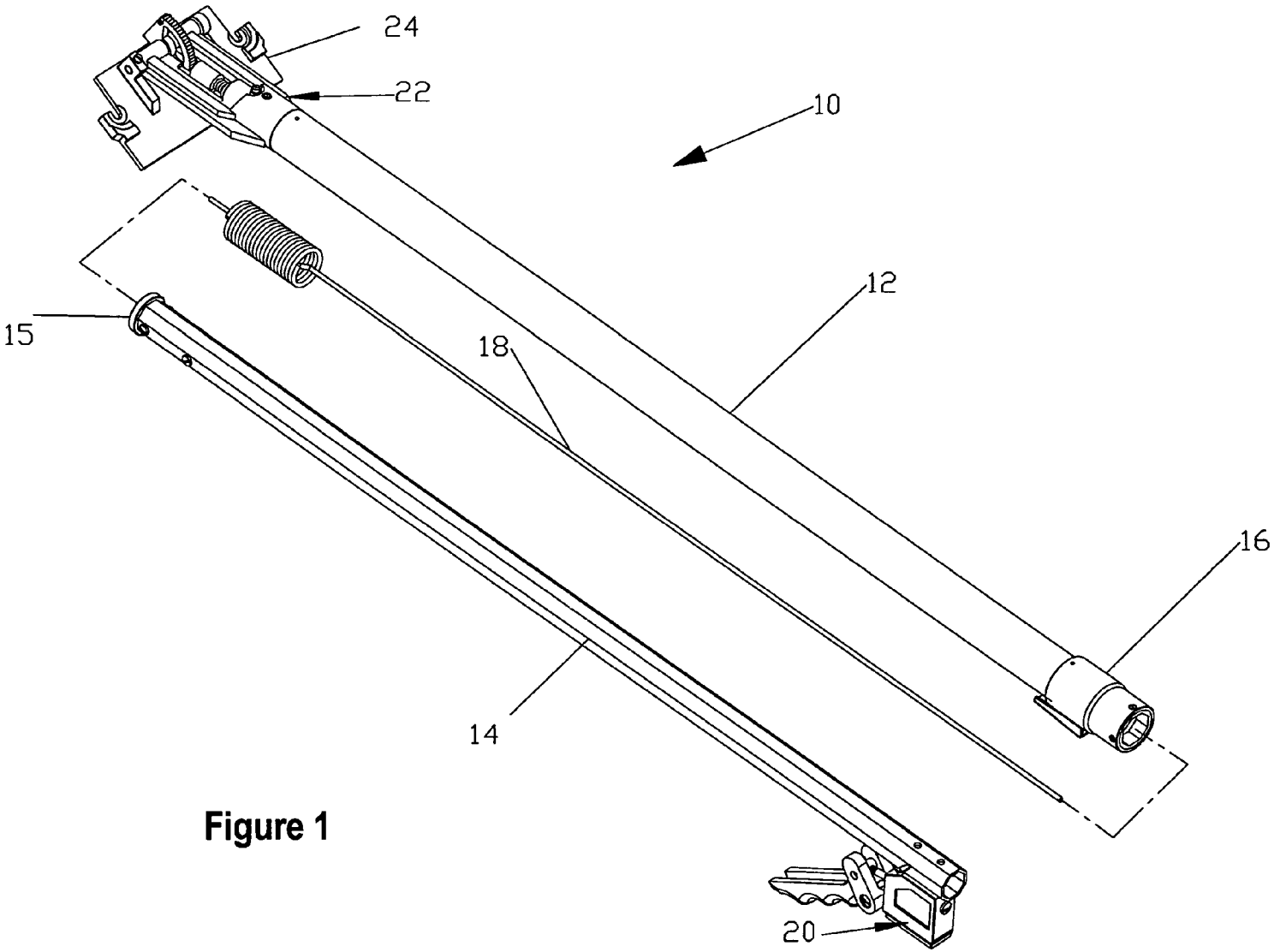
FIG. 1 is an exploded perspective view of an apparatus according to a first embodiment of the invention.

Referring to FIG. 1, an apparatus according to a first embodiment of the invention is shown generally at 10. A first handle portion is shown generally at 12, a second handle portion is shown generally at 14, a handle extension locking mechanism is shown generally at 16, a hydraulic hose is shown generally at 18 and an actuator is shown generally at 20. Still referring to FIG. 1, a connector shown generally at 22 is connected to the first handle member 12 and pivotally connected to a tool plate shown at 24. Also shown in FIG. 1 is a plug 15 inserted in one end of the second handle. As used herein, the term "handle" will be understood by persons of skill in the art to comprise one or more handle portions. The "handle" may be of fixed length or extendible depending on the desired use.

Figure 2:
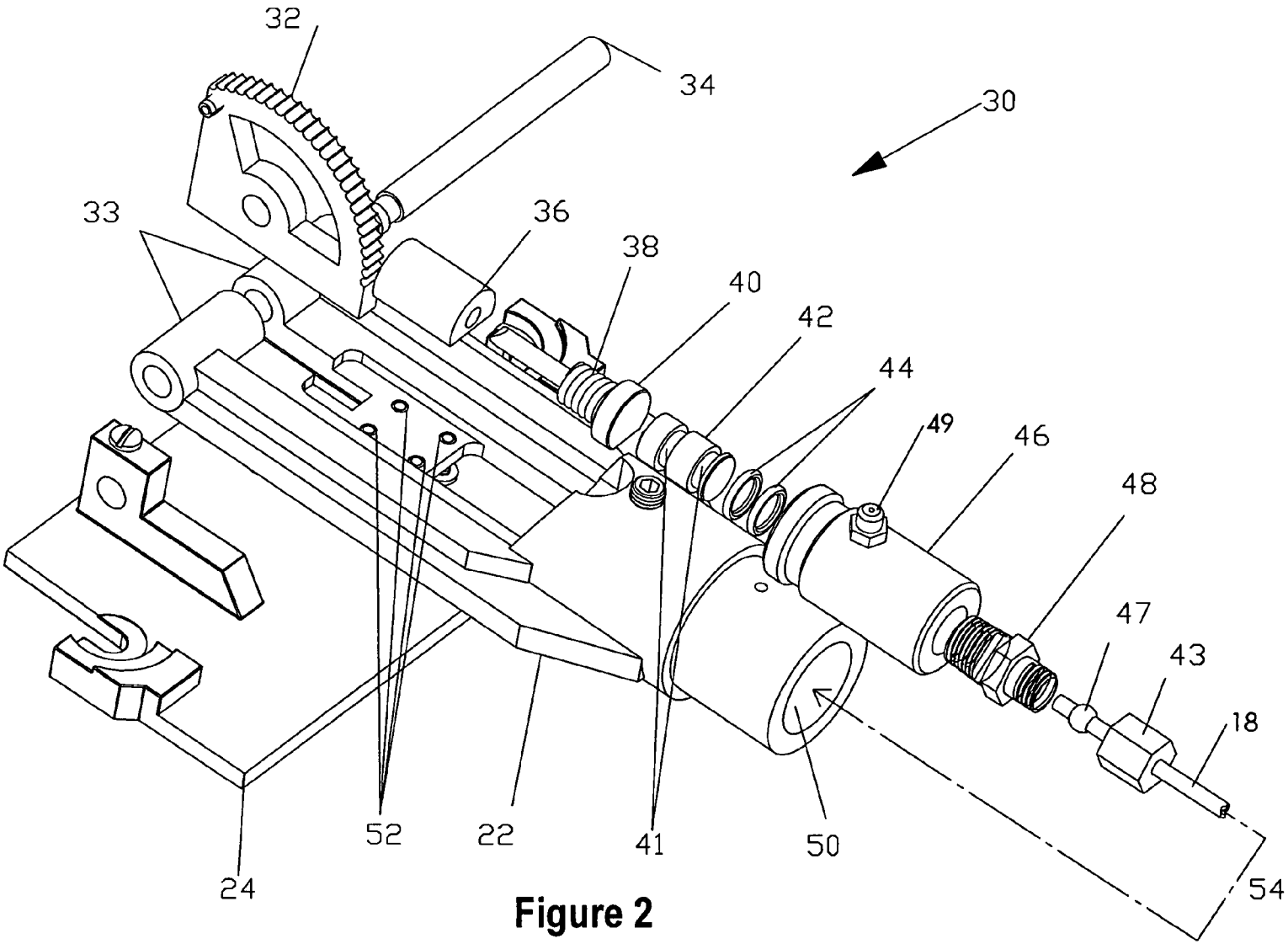
FIG. 2 is an exploded perspective view of a portion of the apparatus shown in FIG. 1, showing a tool plate, connector and brake assembly.

Referring to FIG. 2, the tool plate connector and brake assembly are shown generally at 30. The tool plate 24 is pivotally connected to the connector 22 by pivot pin 34, which also acts to connect a brake dial 32 adjacent to the connector 22 between pivot pin guides 33 of the connector 22. The brake dial 32 is biased against the tool plate 24, whereby pivoting of the tool plate 24 results in pivoting of the brake dial 32. The hydraulically actuated brake assembly is collectively shown at 36, 38, 40, 41, 42, 44 and 46 in an exploded view. Still referring to the brake assembly, a pin guide is shown at 36 attached to the connector at positions 52. A spring 38 acts to bias a brake pin 40 away from the brake dial 32. The brake pin 40 is dimensioned to pass through the brake assembly spring 38 and pin guide 36 to engage the brake dial 32. A ram 42 with O-rings 44 is provided. The O-rings 44 are dimensioned to attach to the ram 42 at grooves 41. The assembled O-rings 44 and ram 42 are dimensioned to have a slidable fit within a ram housing 46. The slidable fit of the ram 42 and O-rings 44 within the ram housing 46 is necessary so that when hydraulic fluid displaced by actuator (20 see FIG. 1) is transmitted through the hydraulic hose 18, through a hose connector 48 and into the ram housing 46, the ram 42 is driven against the brake pin 40. The brake pin 40 in turn compresses spring 38 and moves through the pin guide 36 to engage the brake dial 32. The hose connection assembly is shown collectively as 48, 47, 43 and 18. The hydraulic hose projection 47 is positioned near a first end of the hydraulic hose 18 so that it may connectively engage the hose connector 48 whereby the hose attachment cap 43 can releasably secure the hydraulic hose 18 and hydraulic hose projection 47 in the hose connector 48. The hose attachment cap 43 is dimensioned whereby the cap opening distal to the hose connector 48 allows for passage of the hydraulic hose 18 but not the hydraulic hose projection 47. Also shown in FIG. 2 is a pressure release valve 49 positioned on the ram housing 46. The entire brake assembly and hose connection assembly as shown in FIG. 2 is an exploded and disassembled view. When assembled the brake assembly and hose assembly is generally positioned along line 54 and may be inserted into the connector 22 through opening 50.

Figure 3:
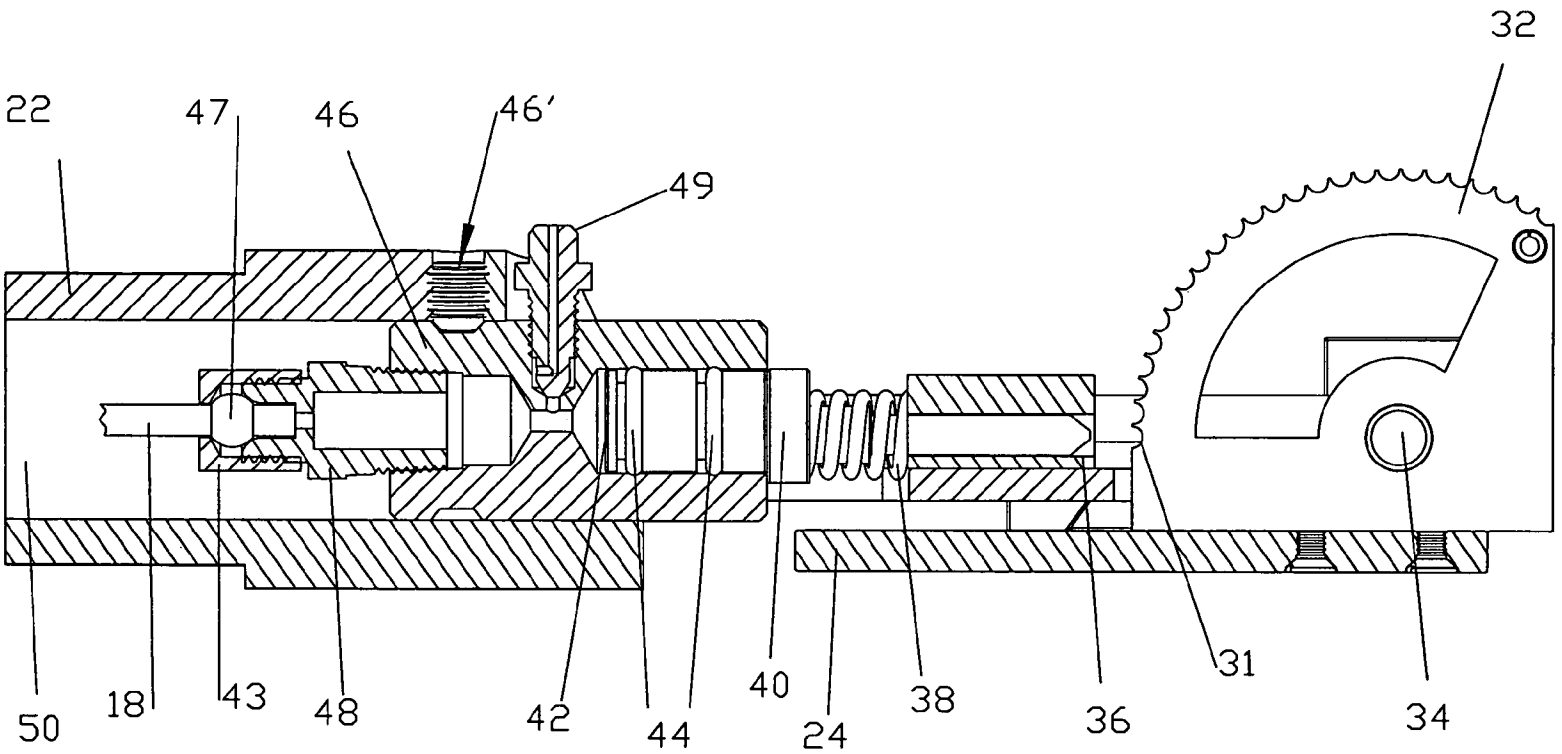
FIG. 3 is a cross -sectional view of the brake assembly assembled within the connector with tool plate attached.

FIG. 3 provides an assembled cross-sectional side view of the brake assembly positioned within the connector 22 with the tool plate 24 and brake disk 32 attached. In the illustrated arrangement, the brake assembly is not engaging the brake dial 32 at notch 31. The assembled hose connection assembly shows the hydraulic hose projection 47 secured within the hose connector 48 by the hydraulic hose attachment cap 43 with the hydraulic hose 18 leading out of the connector 22. The hose connector 48 is also shown positioned within one end of the ram housing 46, which is in turn positioned within the connector 22. The ram 42 and O-rings 44 are in turn positioned within the ram housing 46. The ram 42 is positioned adjacent the brake pin 40. The brake pin 40 is biased by spring 38 to a default unlocked position, wherein the brake pin 40 is not engaged with the brake disk 32. When the brake assembly is actuated, the brake pin 40 will move through the opening defined by the pin guide 36 to engage the brake dial 32 at any one of the notches 31 along the adjacent edge of the brake disk to prevent pivotal movement of the brake disk and the tool plate 24. Also shown in FIG. 3 is a pressure release valve 49, hydraulically connected to pressure conducting opening in the ram housing 46. The pressure release valve is configured to release ram housing pressure in the normal operation of the apparatus. Ram housing 46 is preferably releasably held within opening 50 of connector 22 by a set screw 46'.

Figure 4:
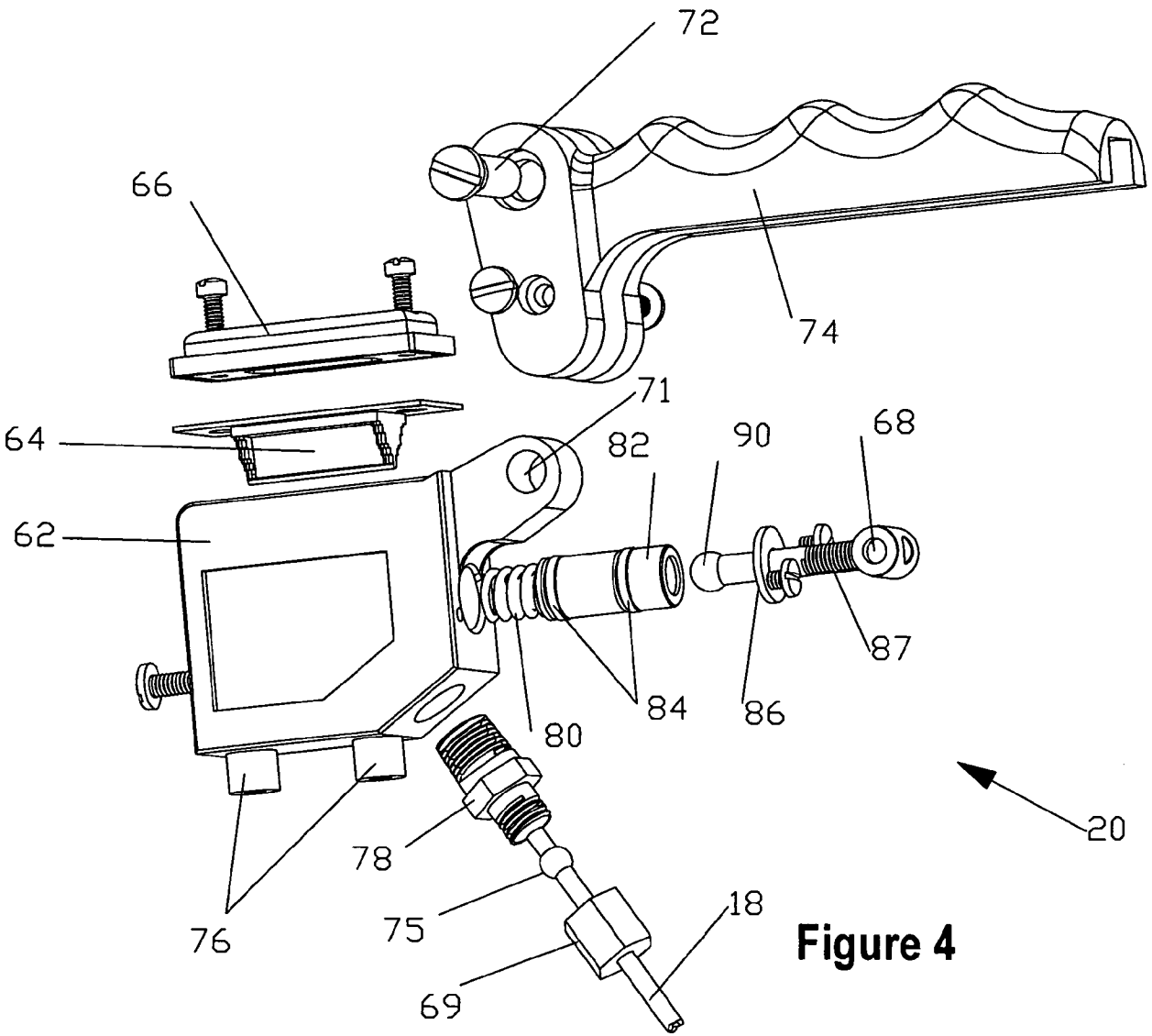
FIG. 4 is an exploded perspective view of a portion of the apparatus shown in FIG. 1, specifically showing the actuator.
Figure 13:
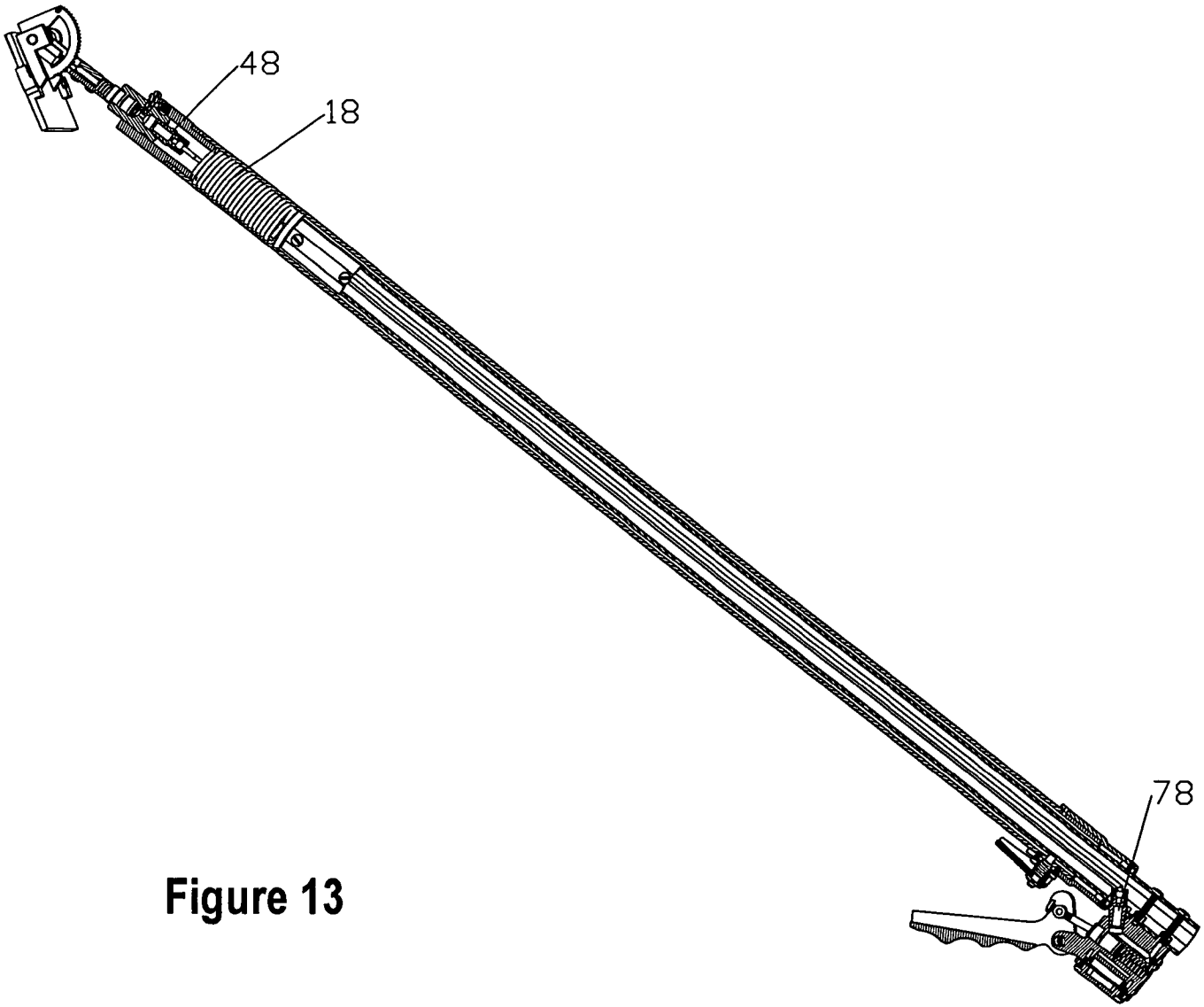
FIG. 13 is a partial cross-sectional side view of the apparatus shown in FIG. 12.
Figure 14:
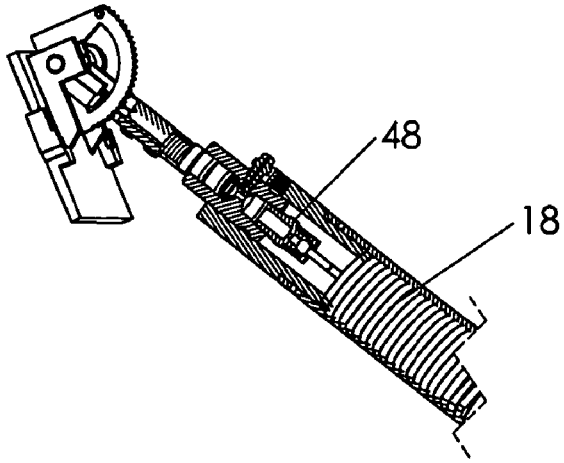
FIG. 14 is a partial cross-sectional side view of the brake assembly and actuator shown in FIG. 13.
Figure 14:
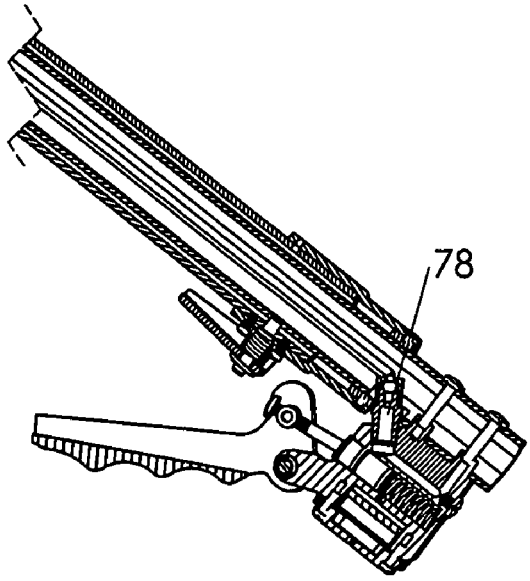

Referring to FIG. 4, an actuator for the brake assembly is shown generally 20 in an exploded view. An actuator body is shown at 62 with a lever handle 74 capable of being pivotally attached to the actuator body by a lever pivot 72. The lever pivot 72 is inserted within a lever pivot opening shown at 71. An attaching means 76 is provided for attaching the actuator body 62 to the second handle portion 14 (see FIG. 1). When the actuator 20 is attached via the attaching means 76 to the handle 14, pressure is prevented from escaping via the attaching means 76 by a screw or bolt used to attach the actuator 20 to the handle 14 as shown in FIGS. 13 and 14. A gasket 64 and a cap 66 are also shown and operable to fit an outer opening to a hydraulic fluid receptacle 65 (see FIG. 5) to form a seal at the outer opening of the hydraulic fluid reservoir and also to attach to the actuator body 62. Still referring to FIG. 4, an actuator hose connector is 78 is dimensioned to connect to an actuator hydraulic hose projection 75, which is positioned near a second end of the hydraulic hose 18 so that it may connectively engage the actuator hose connector 78 whereby the actuator hose attachment cap 69 can releasably secure the hydraulic hose 18 and hydraulic hose projection 75 in the actuator hose connector 78. The actuator hose attachment cap 69 is dimensioned such that the cap opening distal to the actuator hose connector 78 allows for passage of the hydraulic hose 18 but not the actuator hydraulic hose projection 75. Also shown in FIG. 4 is a handle pressure adapter 68 which is pivotally attachable to the lever handle 74. The handle pressure adapter 68 threadingly engages a post 90 by post threads 87. The post 90 is in turn attached to an actuator ram 82, which is biased by a spring return 80. The actuator ram 82 has two O-rings 84. The actuator ram 82 and O-rings are dimensioned to have a slidable fit within the hydraulic cylinder 81 (see FIG. 10) to seal the cylinder against leakage. Also shown in FIG. 4 is a closure 86, which is operable to secure the spring return 80, the O-rings 84, the actuator ram 82 unthreaded terminus of the post 90 within the actuator body 62.

Figure 5:
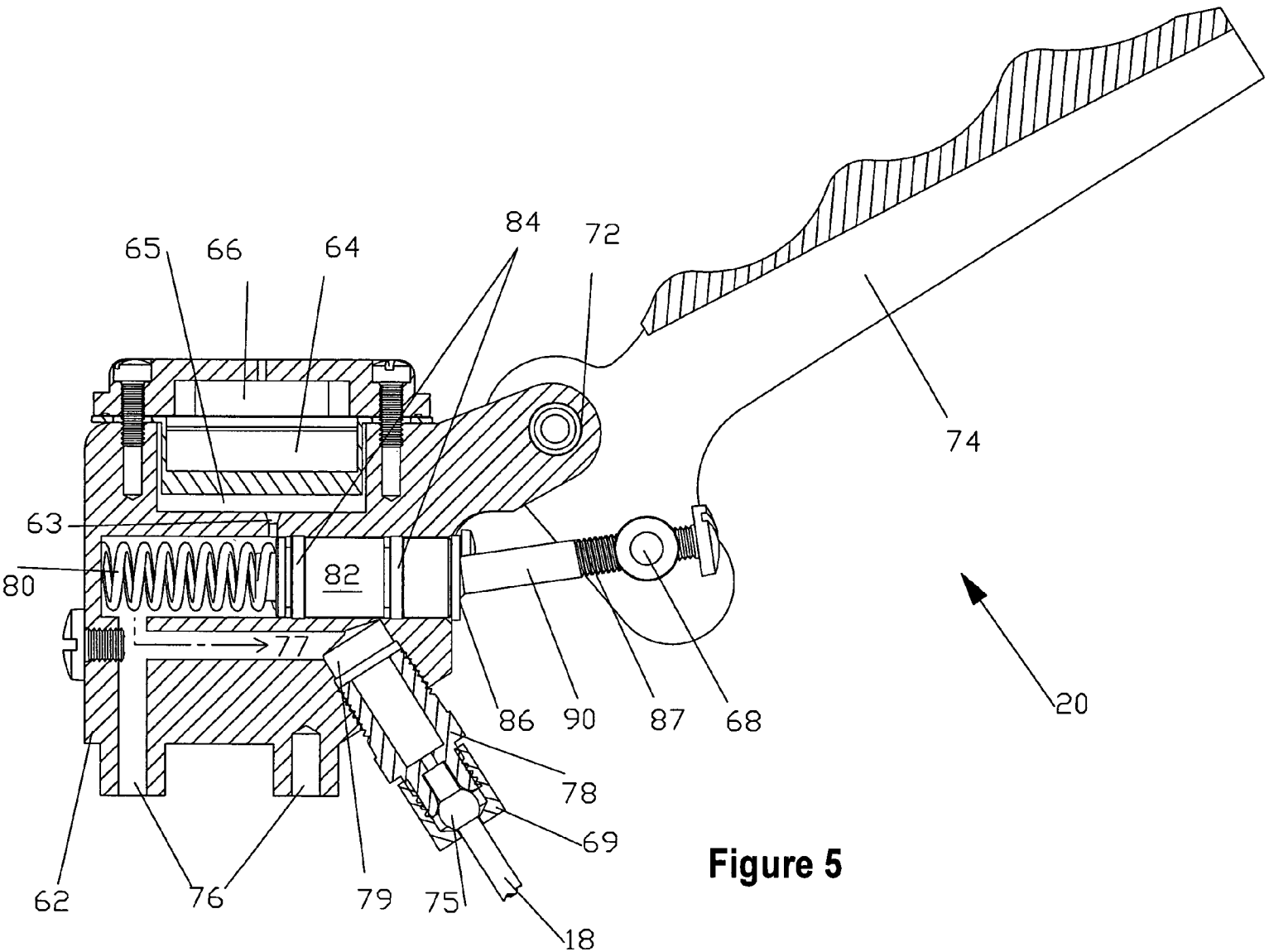
FIG. 5 is a cutaway side view of the actuator shown in FIG. 4, showing an assembled actuator.

Referring to FIG. 5, a partial cross-sectional view of the actuator is shown. The actuator body 62 defines an actuator hose connector opening 79 and a hydraulic cylinder 81. The actuator hose connector 78 is shown situated within the actuator hose connector opening 79. The spring return 80, actuator ram 82, O-rings 84, and the post 90 are assembled within the hydraulic cylinder 81 and are shown secured with the closure 86. The actuator body 62 has a hydraulic fluid reservoir defined by a hydraulic fluid receptacle 65. A fluid reservoir opening is shown at 63, connects the fluid reservoir with the hydraulic cylinder 81. The hydraulic fluid receptacle 65 is shown to be sealed with a gasket 64 and a cap 66. Both the cap and the gasket are dimensioned such that they may be attached to the hydraulic fluid receptacle 65 to form a seal at the outer opening of the hydraulic fluid reservoir. Still referring to FIG. 5, post 90 is biased against the handle pressure adapter 68 by the spring return 80 with post threads 87 engaged with a threaded opening on the handle pressure adapter 68. When lever handle 74 is actuated, the post 90 is pushed longitudinally towards the opposite end of the hydraulic cylinder 81 and subsequently drives the actuator ram 82 longitudinally towards the opposite end of the hydraulic cylinder 81 past the fluid reservoir opening 63 and compresses the spring return 80. Pressure generated by the movement of the actuator ram 82 moves out of the hydraulic cylinder and towards the actuator hose connector opening 79 as shown by directional arrow 77. When the actuator 20 is attached via the attaching means 76 to the handle 14, pressure is prevented from escaping via the attaching means 76 by a screw or bolt used to attach the actuator 20 to the handle 14 as shown in FIGS. 13 and 14.

Figure 9A:
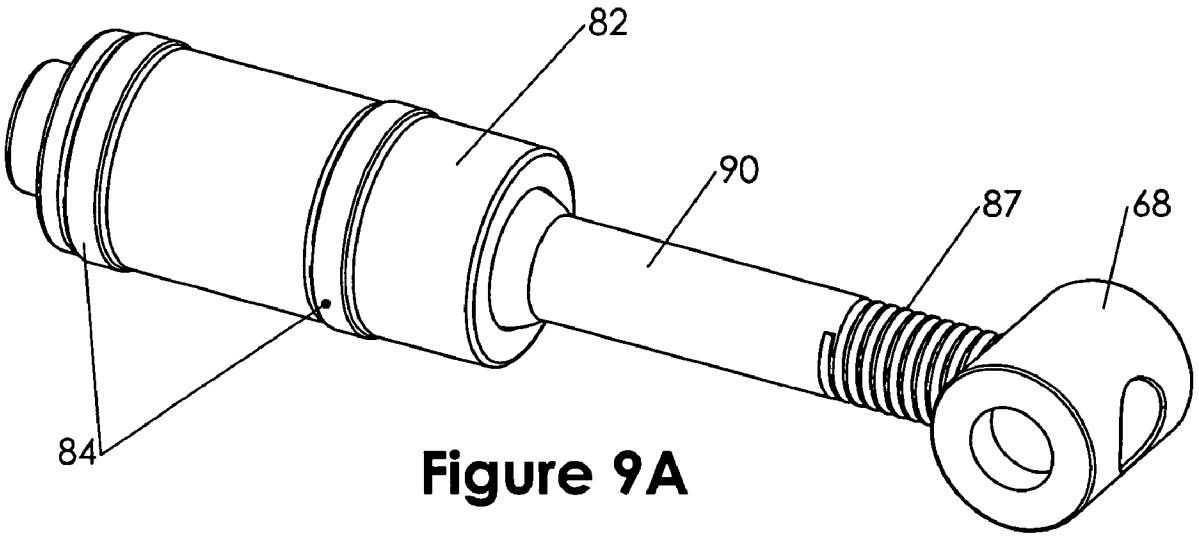
FIG. 9(*a*) is a detailed perspective view of the actuator ram, post and handle pressure adaptor isolated from the actuator apparatus shown in FIGS. 4 and 5.
Figure 9B:
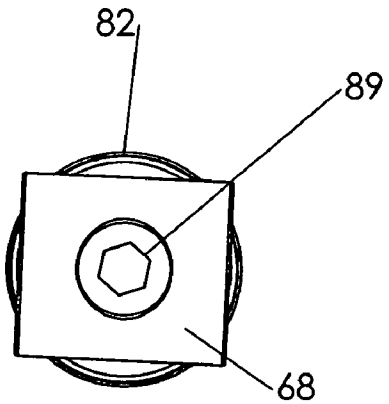
Figure 9C:
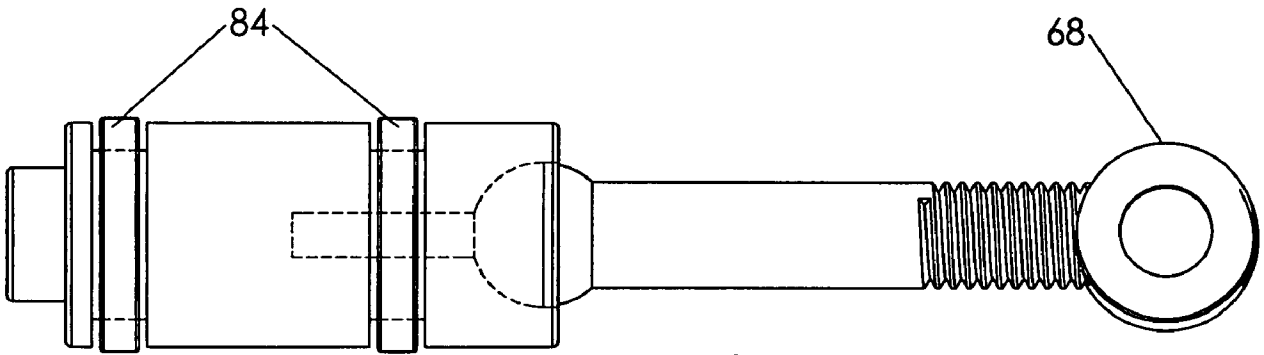

Referring to FIGS. 9(*a*), (*b*) and (*c*), detailed perspective, end and side views are shown of the handle pressure adapter 68, the post 90 and actuator ram 82. Also shown in FIGS. 9(*a*) and (*b*) are the O-rings 84. The handle pressure adapter 68 has a threaded opening for receiving the post threads 87 of the post 90. The handle pressure adapter 68 is operable to rotate when attached to the lever handle which aids in pushing the post 90 against the actuator ram 82 when the lever handle is actuated. An Allen key (not shown) can be fitted through a threaded opening as shown in FIG. 9(*b*) in the handle pressure adapter 68 to engage the Allen key opening 89 on the post 90. The post 90 may then threaded through the threaded opening of the handle pressure adapter 68 by rotation of the Allen key (not shown). FIG. 9(*c*) also shows the interaction between a ball end of post 90 and a ball socket of actuator ram 82.

Figure 10:
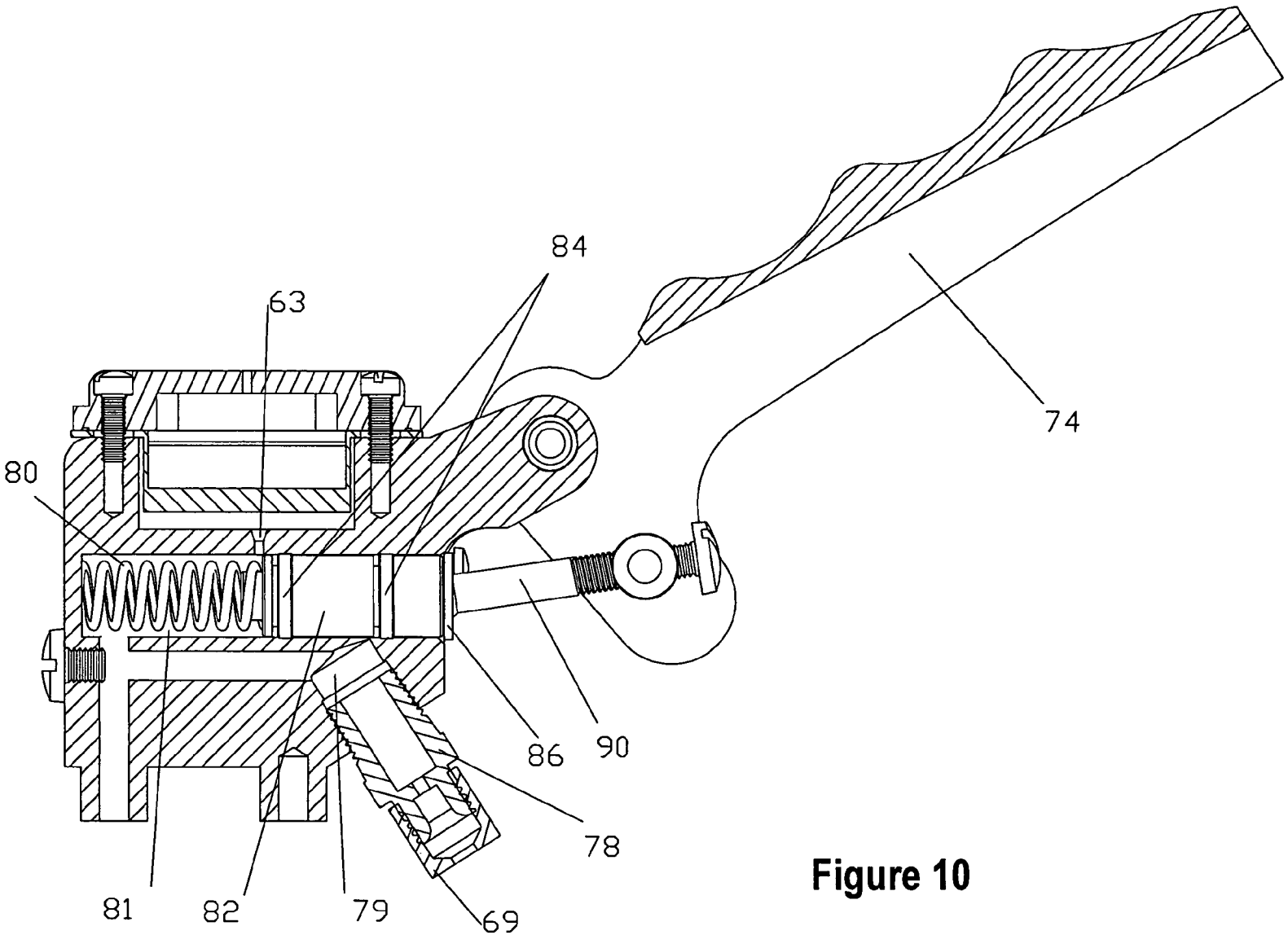
FIG. 10 is a cross-sectional side view of the actuator shown in FIGS. 4 and 5 in an un-actuated position.
Figure 11:
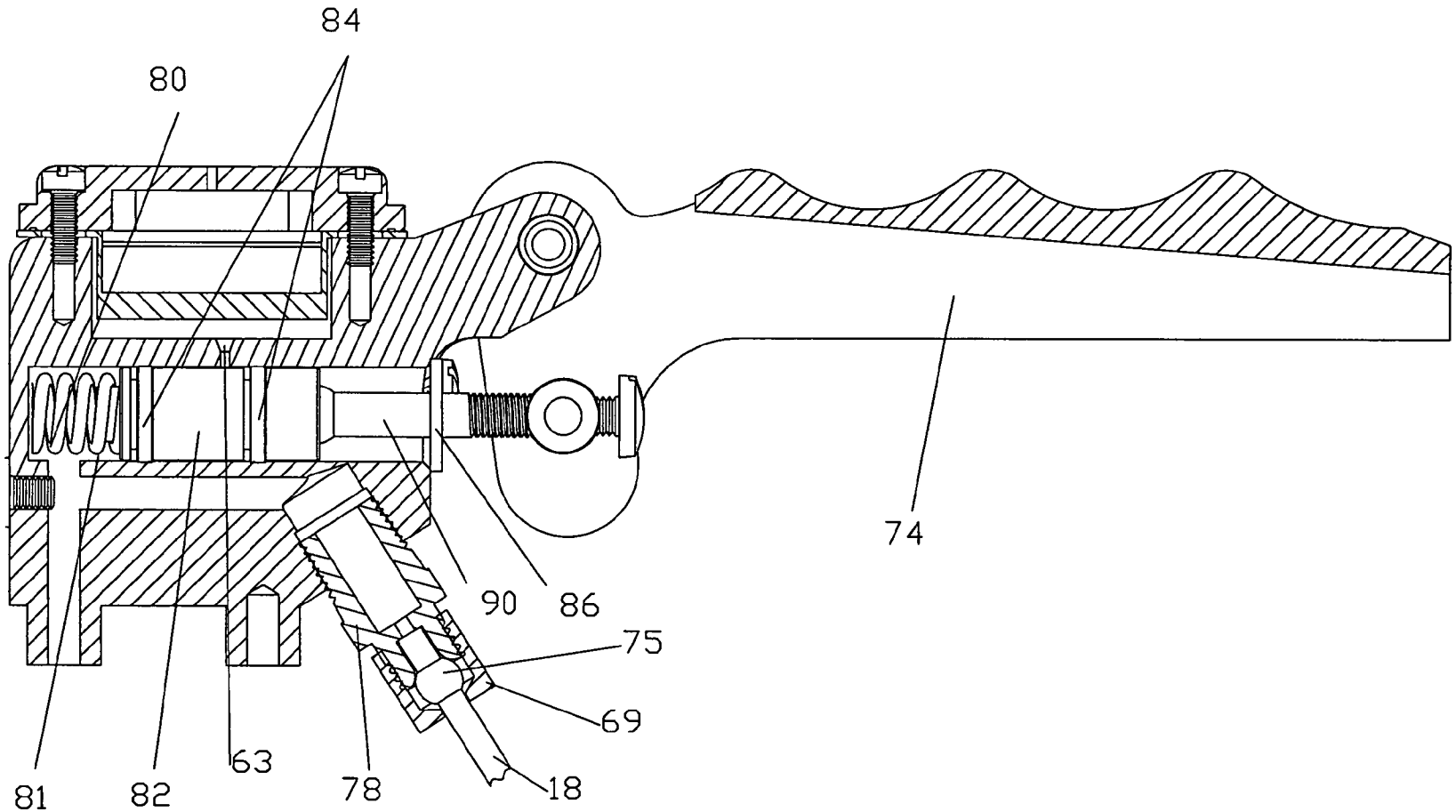
FIG. 11 is a cross-sectional side view of the actuator shown in FIGS. 4, 5 and 10 in an actuated position.

Referring to FIG. 10, shows a partial cutaway side view of the actuator assembly in a default un-actuated position where the return spring 80 biases the actuator ram 82 and post 90 towards the lever handle 74. The fluid reservoir opening 63 is not obstructed by the actuator ram 82, thus allowing fluid communication between the hydraulic fluid reservoir and the hydraulic cylinder 81. FIG. 11 shows the actuator in an actuated position in which the handle 74 is actuated by a user driving the post 90 and actuator ram 82 towards the return spring 80 causing the spring to compress. In the actuated position, the actuator 82 blocks the fluid reservoir opening and thereby prevents communication between the fluid reservoir and the hydraulic cylinder 81. In operation, the hydraulic system is loaded with fluid, and when the actuator ram 82 is in the un-actuated position the reservoir opening 63 is uncovered allowing fluid to move between the hydraulic fluid reservoir and the hydraulic cylinder 81. Once the actuator ram 82 is actuated it moves forward simultaneously pulling fluid from the hydraulic fluid reservoir into the hydraulic cylinder 81 and pushing fluid from the cylinder into the hydraulic hose. In moving forward, the actuator ram blocks the fluid reservoir opening 63 to pressurize the fluid in the system which is transmitted through the hydraulic hose to the opposite end of the handle. When the handle 74 is released the return spring 80 and the actuator ram 82 return to the un-actuated position. In the un-actuated position, hydraulic fluid is allowed to return into the cylinder.

Figure 6A:
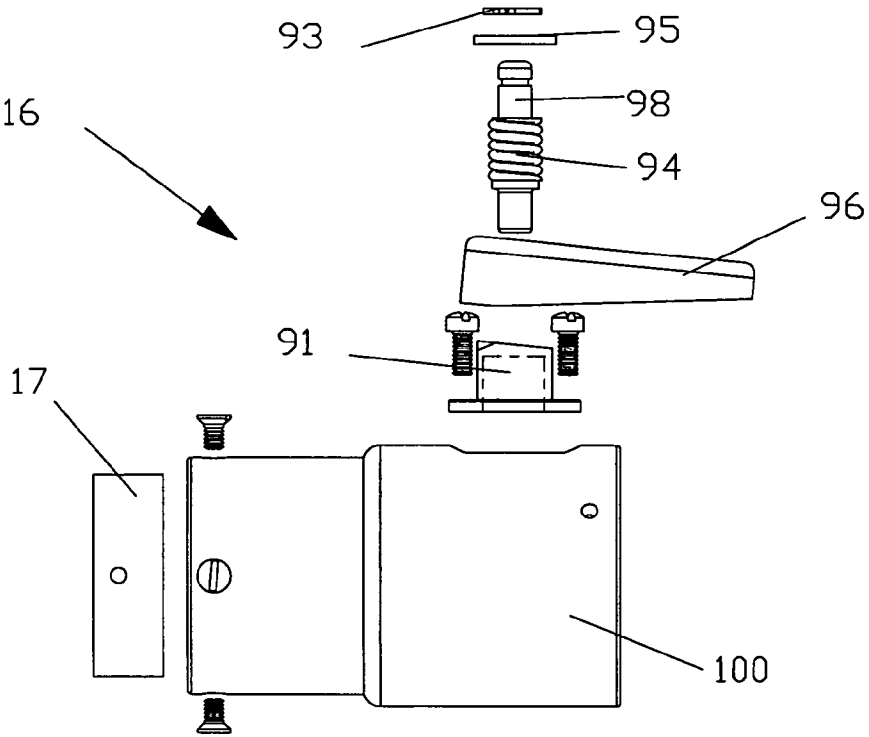
FIG. 6(*a*) is an exploded end view of a portion of the apparatus show in FIG. 1, showing the extension locking mechanism.
Figure 6B:
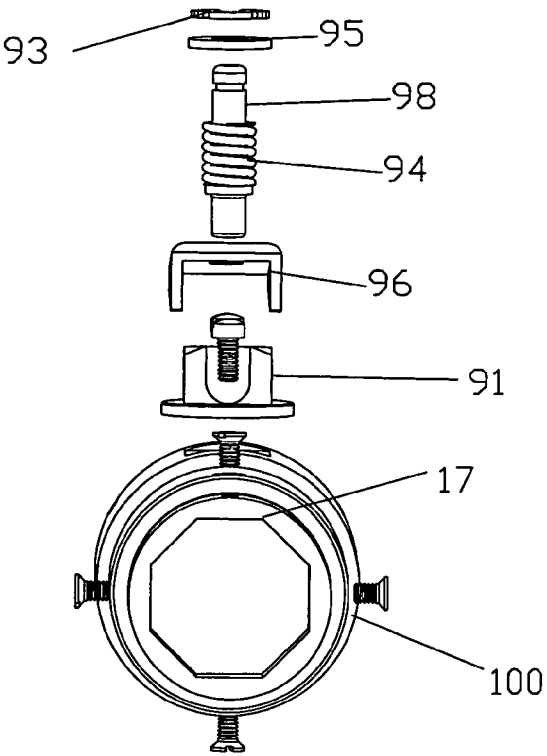

Referring to FIGS. 6(*a*) and (*b*), the extension lock mechanism for adjusting the length of the handle by adjusting the telescoped positions of handle portions 12 and 14 is shown in exploded end and side views respectively. In FIG. 6(*b*) the extension lock mechanism is shown generally at 16 in FIG. 6(*b*). For an assembled extension lock mechanism see FIGS. 13 and 14. An extension lock handle mount is shown at 100 attachable to the first handle portion 12 (see FIG. 1). An extension lock base is shown at 91 and is attachable to the lock handle mount 100. An extension lock lever 96 is pivotally attachable to the extension lock handle mount 100 and the extension lock base 91 by an extension lock spring 94 and an extension lock pin 98. The extension lock pin 98 and associated extension lock spring 94 are operable to insert through the extension lock base 91 and the extension lock handle mount 100 respectively to engage with the lock pin stops (101-106) on handle 14. Furthermore, the extension lock lever 96 is dimensioned to receive the extension lock pin 98, whereby the pin passes through the extension lock lever 96 and is secured by a washer 95 and a c-clip 93. Additionally, the extension lock pin 98 is dimensioned receive the washer 95 and the c-clip 93 to prevent the extension lock pin 98 from pulling through the extension lock lever 96. The extension lock spring 94 is positioned between the extension lock base 91 and the extension lock lever 96 to bias the extension lock lever 96 away from the extension lock handle mount 100. The extension lock pin 98 is operable to engage the lock pin stops (101, 102, 103, 104, 105 and 106 in FIG. 7) on the second handle portion 14 thereby preventing the handles 12 and 14 from sliding relative to one another. When the extension lock lever 96 is pressed towards the handle, the extension lock spring 94 is compressed and the extension lock pin 98 is pulled away from the handle thus allowing for the handles 12 and 14 to slide relative to one another. Also shown in FIGS. 6(*a*) and (*b*) is a way or guide 17 having a circular outer wall dimensioned to fit within the lock handle mount 100 and having an octagonal inner wall dimensioned to fit around the octagonal handle (14 not shown).

Figure 7:
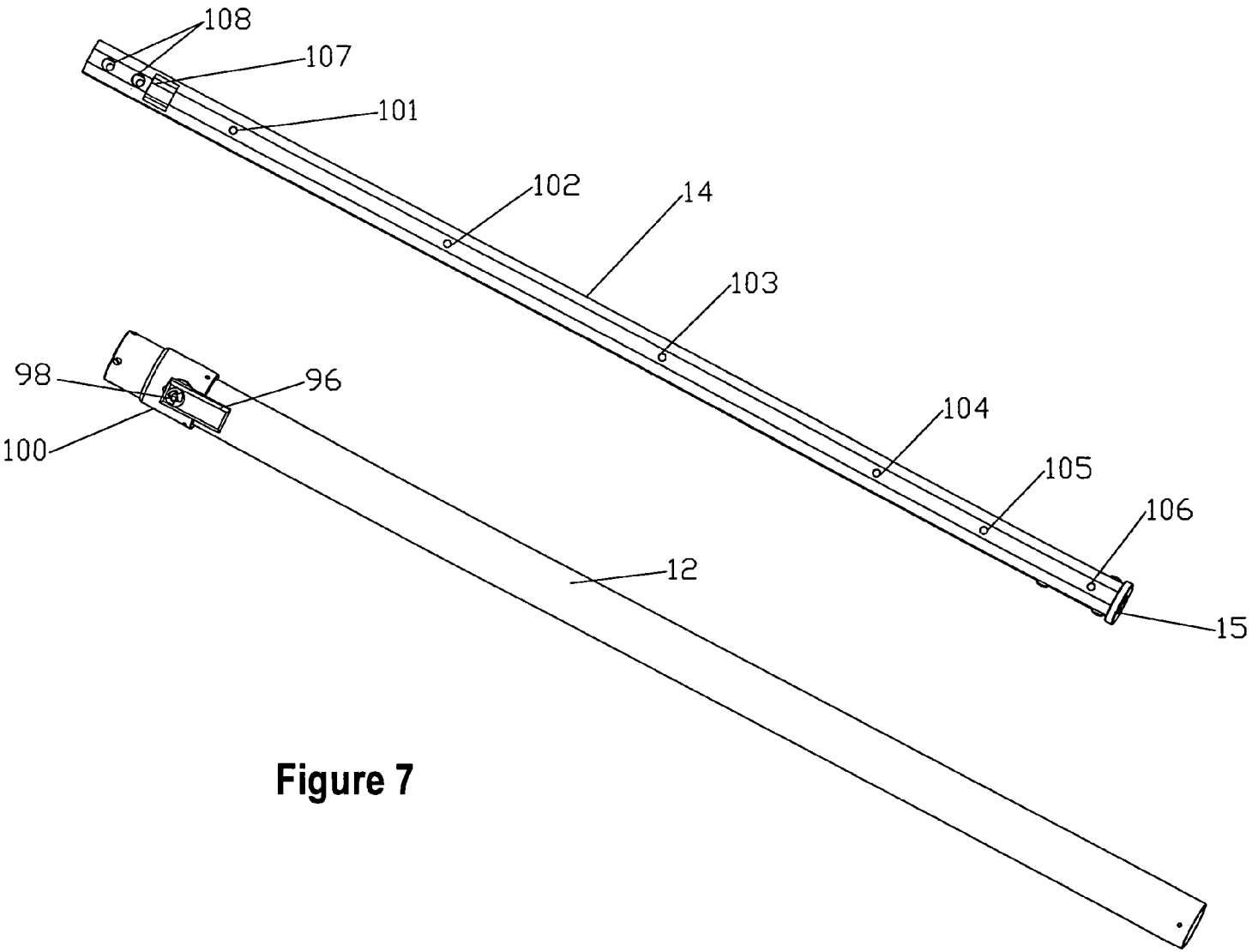
FIG. 7 shows a disassembled perspective view of a portion of the apparatus shown in FIG. 1, showing the handle and extension locking mechanism.

FIG. 7 shows the first and second handle portions 12 and 14 partially disassembled. Referring to the second handle portion 14, extension lock pin stops are shown at 101, 102, 103, 104, 105 and 106 and are dimensioned to receive the extension lock pin 98 and to aid in maintaining a selected handle extension length. Still referring to second handle portion 14, a hydraulic hose opening is shown at 107 and handle mount openings are shown at 108. Referring to first handle portion 12, the extension lock lever 96 is shown pivotally attached to the extension lock handle mount 100, and the extension lock pin 98 is shown positioned within the extension lock lever 96.

Figure 8:
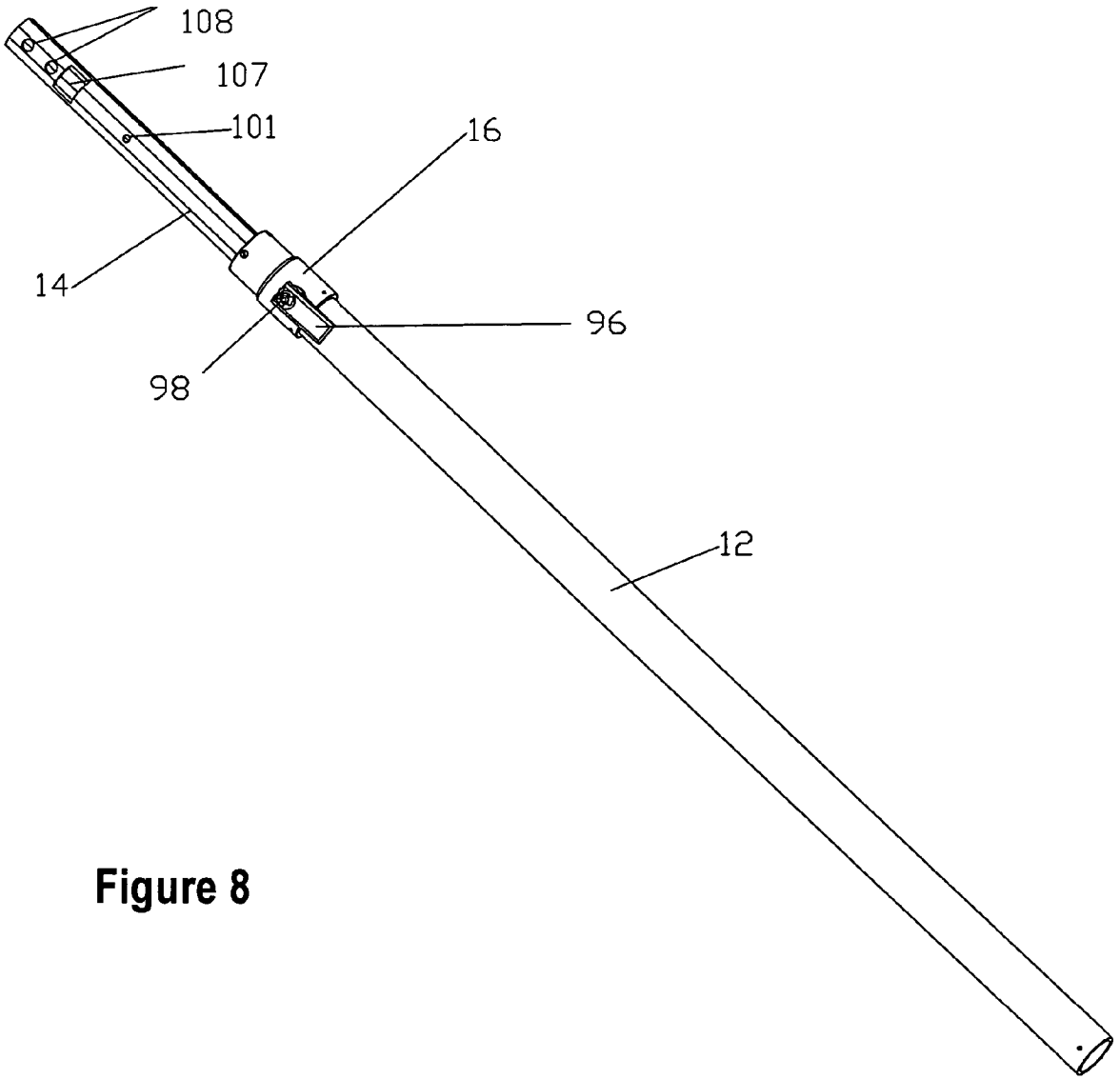
FIG. 8 is an assembled perspective view of the apparatus shown in FIG. 7.

Referring to FIG. 8, the first and second handle members 12 and 14 are shown assembled whereby second handle portion 14 is dimensioned to fit telescopically within the first handle portion 12. In this particular embodiment, second handle portion 14 is octagonal and first handle portion 12 is dimensioned to receive the octagonal cross-section of second handle portion 14. The extension lock pin 98 is positioned so that it is operable to engage the lock pin stops 101 shown (102, 103, 104, 105 and 106 not shown in FIG. 8) on the second handle portion 14.

Figure 12:
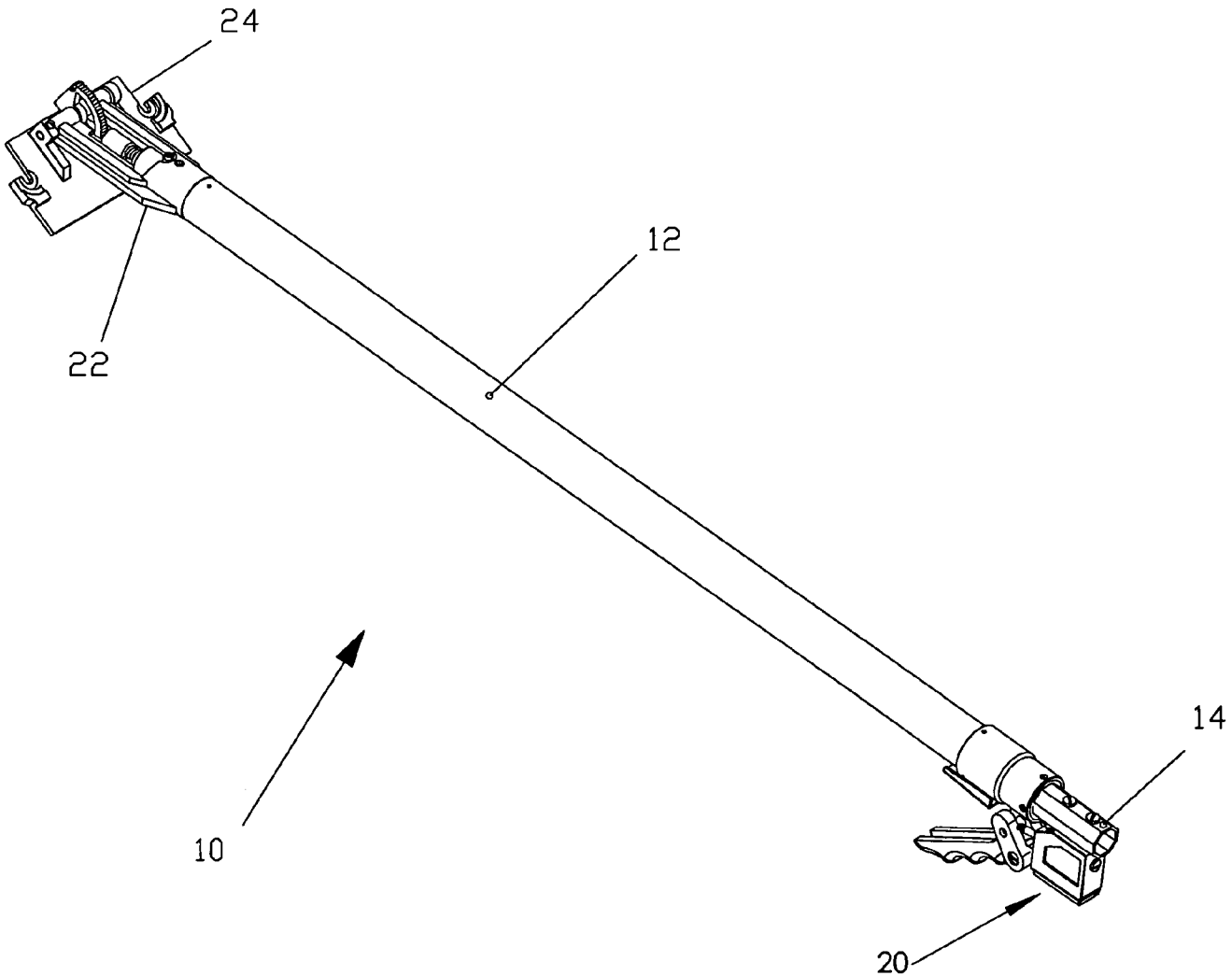
FIG. 12 is an assembled perspective view of the apparatus shown in FIG. 1.

Referring to FIG. 12, an assembled handle is shown generally at 10, with the actuator shown generally at 20 attached to the second handle portion 14 which is inserted into the first handle portion 12. First handle portion 12 is in turn attached to the connector 22 which is pivotally attached to the tool plate 24. Referring to FIG. 13, a partial cross-sectional side view of the assembled hydraulic handle shows the hose connector 48 connected to the first end of the coiled hydraulic hose 18 at the tool plate end of the handle and shows the second end of the coiled hydraulic hose 18 connected to the actuator hose connector 78 at the actuator end of the handle.

Referring to FIG. 14 a partial cross-sectional side enlarged to provide greater detail of the apparatus. The hose connector 48 is shown connected to the first end of the coiled hydraulic hose 18 at the tool plate end of the handle and shows the second end of the coiled hydraulic hose 18 connected to the actuator hose connector 78 at the actuator end of the handle.

Figure 15:
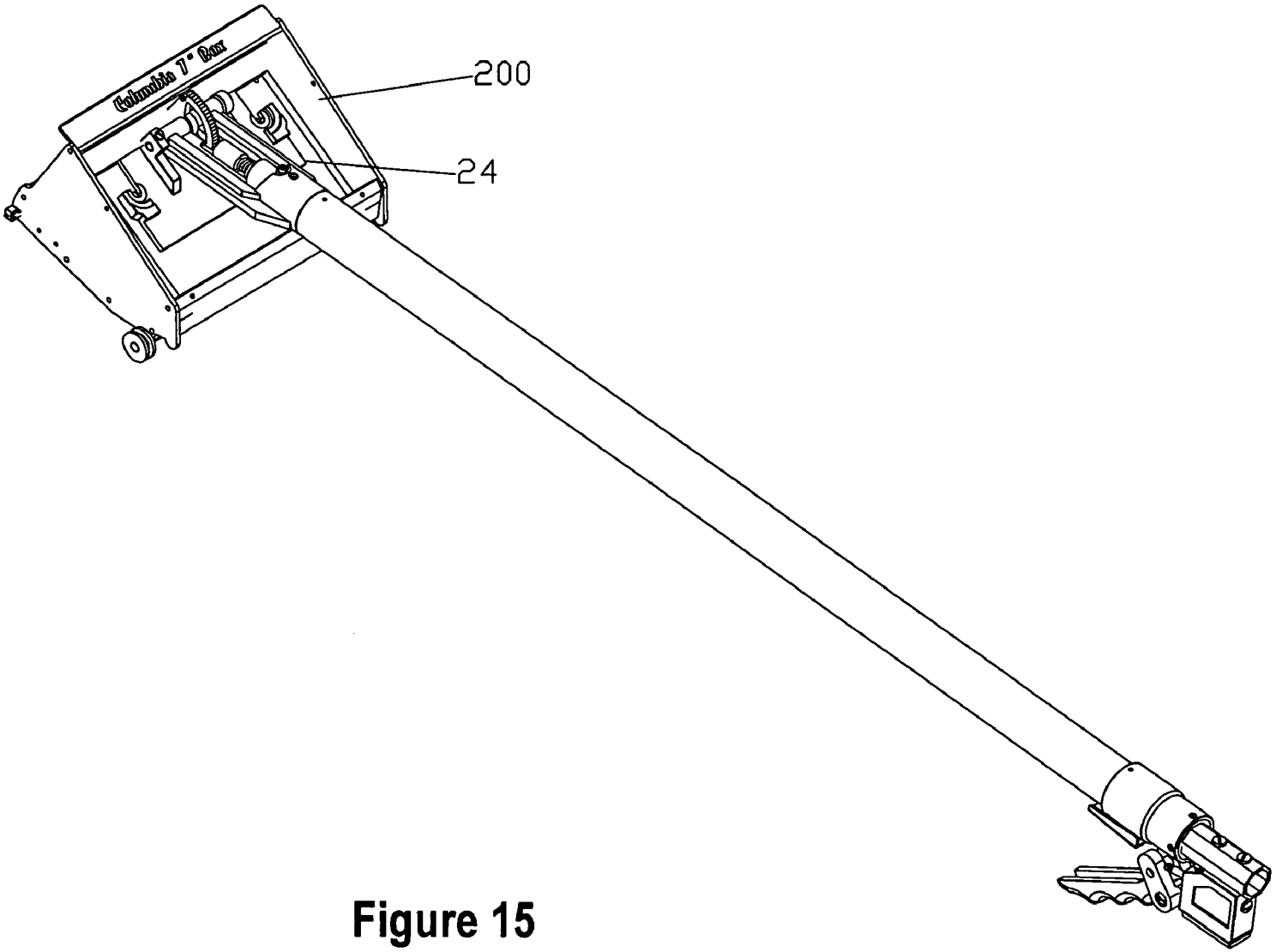
FIG. 15 is an assembled perspective view of the apparatus shown in FIGS. 1, 12, 13 and 14, with a flat finisher box attached to the tool plate.

Referring to FIG. 15, the assembled handle is shown with a flat finisher box 200 connected to the tool plate 24.

Figure 16:
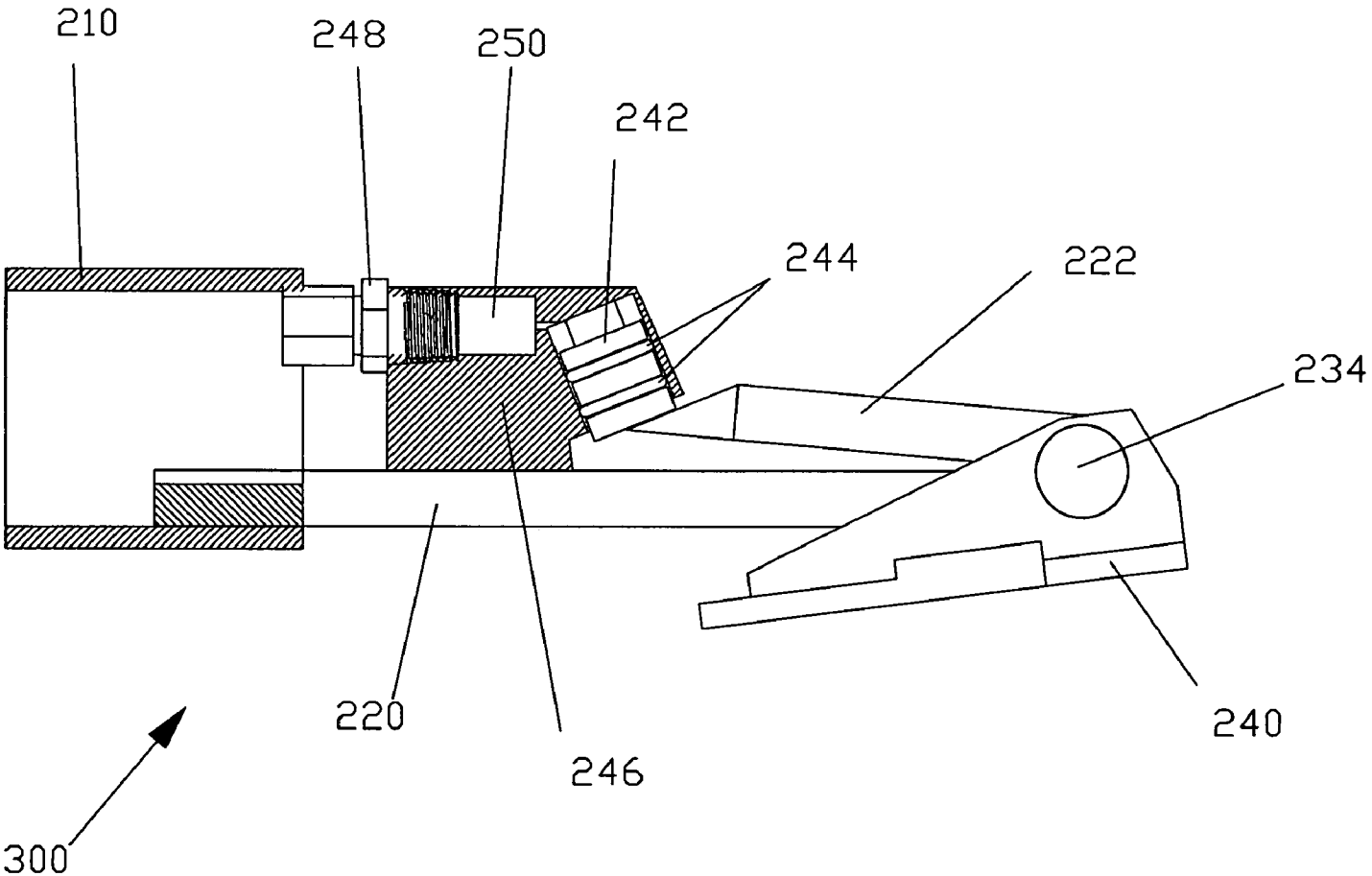
FIG. 16 is a partial cross-sectional side view of an apparatus according to a second embodiment of the brake assembly, showing an alternative embodiment of the tool plate connector and brake assembly configuration.

Referring to FIG. 16, an alternative embodiment of the connector and brake assembly apparatus is shown generally at 300. A handle attachment 210 is operable to connect to the first handle portion. A clamp connector 220 is shown attached to the handle attachment 210. The clamp connector 220 is pivotally attachable to a clamp tool plate 240 via a clamp pivot pin 234. The clamp connector 220 terminates in a clamp connector lever arm 222. A clamp ram housing 246 is attached to the clamp connector 220. The clamp ram housing 246 defines a clamp ram pressure chamber 250 which is operably connected via a clamp hose connector 248 to a hydraulic hose (not shown). Also within the clamp ram housing 246 is a clamp ram 242 with associated clamp ram O-rings 244. The clamp ram 242 and clamp ram O-rings 244 are dimensioned fit slidably in the clamp ram housing 246 to prevent fluid leakage from the clamp ram pressure chamber. The chamber is in fluid communication with the opening in which the clamp ram 242 is situated. The clamp 242 is biased against the clamp connector lever arm 222.

Referring to FIG. 17, an assembled handle is shown in partial cross section showing the alternative clamp connector and brake assembly apparatus of FIG. 16 and shown generally at 300. The brake assembly is operably connected via the clamp hose connector 248 to the hydraulic hose 18, which is in fluid communication with the actuator shown generally at 20. The assembly of the actuator and handle may be the same as for the first embodiment described above or another suitable embodiment.

Figure 18A:
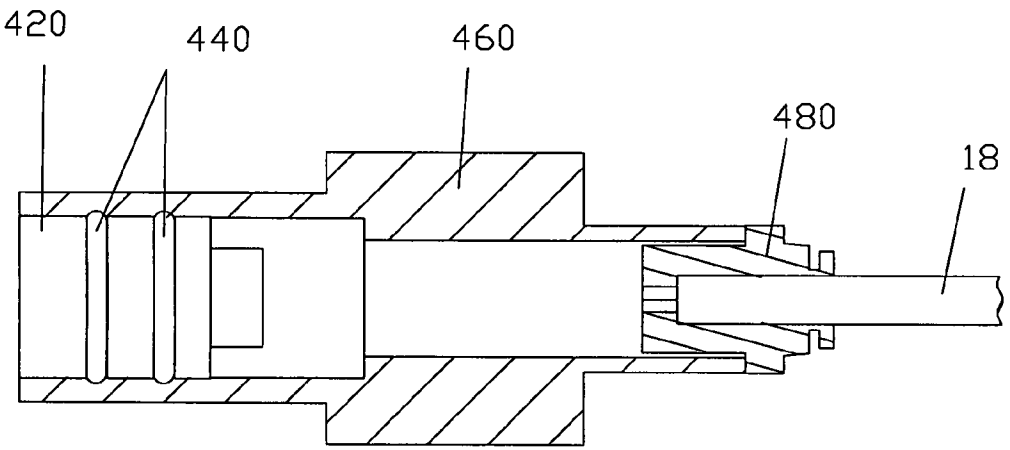
FIG. 18(*a*) a partial cross-sectional side view of an alternate hydraulic hose attachment to the brake assembly.
Figure 18B:
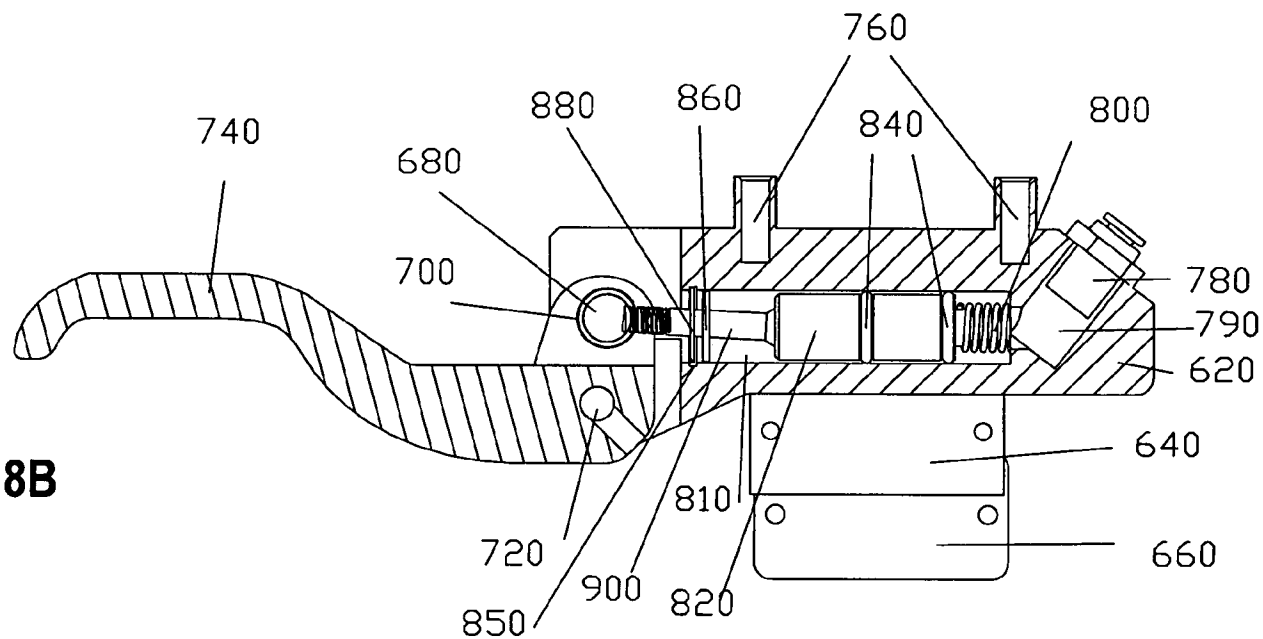

Referring to FIG. 18(*a*), an alternative hydraulic hose connection is shown whereby the hydraulic hose 18 connects directly into a quick hose connector 480, which is in turn operably connected to the ram housing 460 and in fluid communication with the ram 420 with attached O-rings 440.

Referring to FIG. 18(*b*), an alternative actuator for the brake assembly is shown in an partial cross-sectional view. An actuator body is shown at 620 with a lever handle 740 pivotally attached to the actuator body by a lever pivot 720. An attaching means 760 is provided for attaching the actuator body 620 to the second handle (14 not shown). The actuator body 620 has a hydraulic fluid reservoir defined by a hydraulic fluid receptacle (not shown). The hydraulic fluid reservoir is sealed with a gasket 640 and a cap 660. Both the cap and the gasket are dimensioned such that they may be attached to the actuator body to form a seal at the outer opening of the hydraulic fluid reservoir. A fluid reservoir opening (not shown) connects the hydraulic fluid reservoir to a cylinder chamber 810. An actuator hose connector is 780 is dimensioned to connect to the hydraulic hose 18 (not shown) and also to attach to the actuator body 620. Also shown is a handle pressure adapter 680 and handle pressure adapter bushings 700. The handle pressure adapter 680 threadingly engages a post 900. The post 900 is in turn attached to an actuator ram 820, which is biased by a spring return 800. The actuator ram 820 has two O-rings 840. The actuator ram 820 and O-rings are dimensioned to have a slidable fit within the hydraulic cylinder 810 to seal the cylinder against leakage. A backstop washer 860 and a backstop an backstop C-clip 880 positioned on the post 900. The actuator body 620 defines an actuator hose connector opening 790 which is in fluid communication with the hydraulic hose (not shown). The actuator hose connector 780 is shown situated within the actuator hose connector opening 790. Actuator ram 820, O-rings 840, the backstop washer 860, a backstop C clip 880 and the post 900 are assembled within the hydraulic cylinder 810. Post 900 is biased against the handle pressure adapter 680 by the spring return 800 with post 900 threads engaged with a threaded opening on the handle pressure adapter 680. When lever handle 740 is actuated, the post 900 is pushed longitudinally towards the opposite end of the hydraulic cylinder 810 and subsequently drives the actuator ram 820 towards the actuator hose connector opening 790 past the fluid reservoir opening (not shown) and compresses the spring return 800. The backstop C-clip 880 is dimensioned to fit into a hydraulic cylinder notch 850, whereby the backstop C-clip 880 is compressed to fit into the hydraulic cylinder notch 850. The backstop C-clip 880 partially engaging the hydraulic cylinder notch 850 and is designed to hold the actuator ram 820, the O-rings 840, backstop washer 860 and spring return 800 within the hydraulic cylinder 810. The C-clip is inserted into the into the hydraulic cylinder notch 850 after the post 900, the actuator ram 820, the O-rings 840, backstop washer 860 and spring return 800 are inserted into the hydraulic cylinder 810. The backstop C-clip 880 may be inserted into the hydraulic cylinder notch 850 with the aid of a C-clip compressor tool (not shown).

Figure 19A:
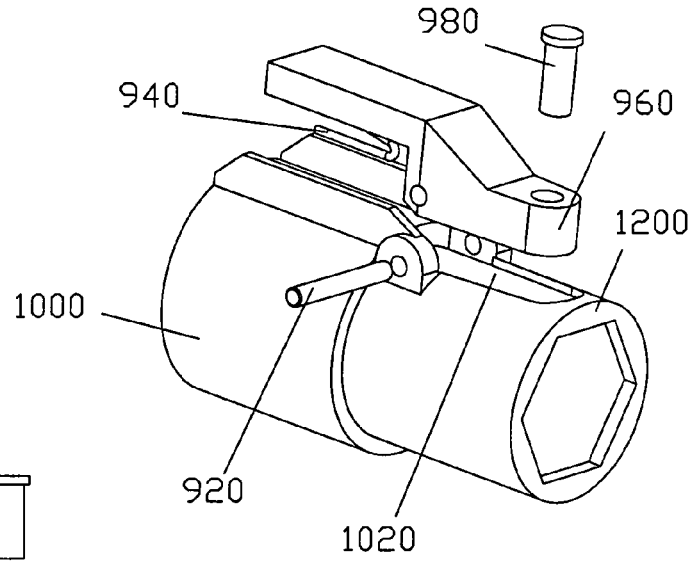
FIG. 19(*a*) is an exploded perspective view of an alternate extension locking mechanism.
Figure 19B:
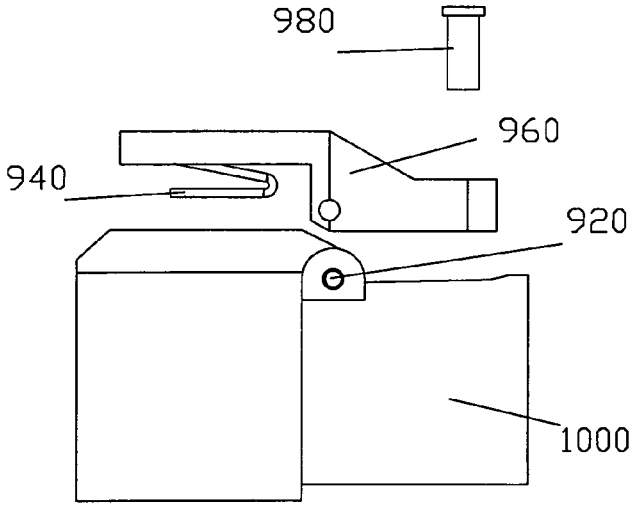
Figure 19C:
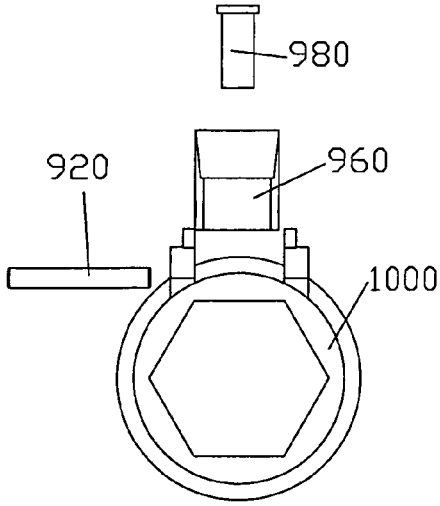

Referring to FIGS. 19(*a*), (*b*) and (*c*), an alternative extension lock mechanism is shown in perspective, side and end exploded views respectively. An extension lock handle mount is shown at 1000 attached to a first handle 1200, having a hexagonal inner wall. An extension lock lever 960 is pivotally attachable to the extension lock handle mount 1000 by an extension lock pivot 920. An extension lock spring 940 is positioned between the extension lock handle mount 1000 and the extension lock lever 960 to bias the extension lock lever 960 away from the extension lock handle mount 1000. An extension lock pin 980 is dimensioned to fit in an opening defined by the extension lock lever 960 and to pass through the opening at 1020 defined in the first handle 1200. The extension lock pin 980 is operable to engage a lock pin stops (101, 102, 103, 104, 105 and 106 as shown in FIG. 7) on the second handle.

Operation

Referring to FIGS. 3, 10, 11 and 13, operation of a first embodiment of the invention may be understood. In the un-actuated position, shown in FIG. 10, the fluid reservoir opening 63 is not obstructed by the actuator ram 82 and allows fluid communication between the hydraulic fluid reservoir and the hydraulic cylinder 81. In the actuated position, shown in FIG. 11, the lever handle 74 is moved toward the second handle portion 14 which in turn drives the post 90 and actuator ram 82 towards the actuator hose connector opening 79 and thereby compresses the return spring 80. In the actuated position the actuator ram 82 blocks the fluid reservoir opening 63 and thereby prevents communication between the fluid reservoir and the hydraulic cylinder 81. In operation, the apparatus is loaded with fluid, and when the actuator ram 82 is in the un-actuated position the reservoir opening 63 is uncovered allowing fluid to move between the hydraulic fluid reservoir and the hydraulic cylinder 81. Once the actuator ram 82 is actuated, the ram moves away from the actuator lever handle 74, simultaneously pulling fluid from the hydraulic fluid reservoir into the hydraulic cylinder 81 and pushing fluid from the cylinder into the hydraulic hose 18 (as shown in FIG. 11) via the actuator hose connector 78. The actuator ram 82 blocks the fluid reservoir opening 63 to create pressure in the system, which is transmitted through the hydraulic hose 18 to the opposite end of the handle to the hose connector 48 which is in fluid communication with the brake assembly as shown in FIG. 3. Referring to FIG. 3, hydraulic pressure produced by the actuator and transmitted by the hydraulic hose 18, drives the ram 42 against the brake pin 40, which compresses the spring 38 and passes through the pin guide 36 to engage the brake dial 32 at a notch 31 to hold the tool plate and attached tool at a desired angle relative to the handle. Allowing the user of the apparatus to hold the tool plate 24 and attached flat finishing box 200 (as shown in FIG. 15) or other tool securely at various angles. Thereby allowing the user (drywaller) to enter and exit a joint with proper technique.

When the lever 74 is released, the return spring 80 and the actuator ram 82 return to the un-actuated position. In the un-actuated position, hydraulic fluid is allowed to return to the cylinder and decreases hydraulic pressure in the brake assembly, thus allowing the spring 38 to disengage the brake pin 40 from the brake dial 32.

The alternative embodiment shown in FIGS. 16 and 17 operates in much the same way as the first embodiment in terms of the creation of hydraulic pressure by the actuator and transmission of the hydraulic pressure along the hydraulic hose. Referring to FIG. 16, hydraulic pressure from the hydraulic hose is attached to the clamp hose connector 248 creating hydraulic pressure in the clamp ram pressure chamber 250 which is in fluid communication with the clamp ram 242. As hydraulic pressure is exerted on the clamp ram 242 it is driven against the clamp connector lever arm 222 causing the clamp connector lever arm to compress towards the opposing clamp connector 220, which exerts friction on the clamp pivot pin 234 and in turn prevents pivotal movement of the clamp tool plate 240. When the actuator lever 74 is actuated the resultant pressure on the clamp ram 242 exerts force on the clamp connector lever arm 222 which prevents rotation of the clamp pivot pin 234 and subsequently holds the clamp tool plate 240 at a desired angle relative to the handle.

Alternatives

A person of skill in the art will recognize that further alternative arrangements may be used to achieve a similar result. For example, the actuator shown in FIG. 18(*b*) or standard bicycle hydraulic brake levers etc. may be employed as actuators. In addition, alternative braking mechanisms such as the one shown in FIGS. 16 and 17 may be used with any of the actuator assemblies described herein. Similarly, handle locking mechanisms and extension mechanisms such as the one shown in FIG. 19 could be substituted. Many such systems for extending a handle are well known in the art. Numerous connection mechanisms are also known in the hydraulic and pneumatic arts for connecting a pressure bearing hose to an apparatus, which may be substituted. For example, the quick connect assembly shown in FIG. 18(*a*) may be used to connect the hydraulic hose to the actuator or brake assembly.

Numerous other systems of applying hydraulic pressure to stop a swiveling tool plate or tool could be employed including friction based systems similar to the embodiment shown in FIGS. 16 and 17. Although such systems may have fewer moving parts, they often require somewhat higher hydraulic pressure to achieve the same results. A hydraulic system has numerous benefits over existing mechanical handle systems, in that they do not rely on the integrity of the linkage to lock the swivel plate. Linkage in a mechanical system often relies on levers and clamps within the handle which are prone to wear, subsequently reduced durability and increased down time for repairs. Mechanical linkages also generally place greater stresses on the extension locking mechanism, not associated with a hydraulic system.

Also, it would be appreciated by persons of skill in the art, that the apparatus could be configured to have the brake applied in the default (unactuated) position and released upon actuation.

Also it will be appreciated that the hydraulic components described herein could be sold separately or as a kit (optionally with instructions) to modify existing drywall handles. Alternatively, individual components or assemblies (for example, hydraulic hose, actuator, connector and brake assembly or parts thereof) could be sold to maintain existing hydraulically actuated handles.

The hydraulic hose may be coiled. Furthermore, the hydraulic hose may be amenable to heat treatment so that the hydraulic hose may be shaped to fit the apparatus (for example coiling). Furthermore, the hydraulic hose is able to operate at pressures of about 80 pounds per square inch (psi) to about 700 psi. Alternatively, the hydraulic hose is able to operate at pressures of about 100 psi to about 660 psi. Additionally, the hydraulic hose is able to operate at pressures of about 100 psi to about 400 psi. The hydraulic hose may also be selected to operate at pressures of about 200 psi to about 300 psi. The pressures at which the hose operates at are significant in determining the materials used and the stresses that may be applied to the actuator and brake assemblies. For example, having too great a pressure exerted by the apparatus could lead to premature ware of the apparatus and damage to the various components. Furthermore the hydraulic hose must be capable of operating at sufficient pressures to hold the apparatus in the locked position. Hydraulic hose useful in the present invention is hard enough to retain the pressures needed to actuate the apparatus and is heat treatable so that the hydraulic hose can be shaped to fit the apparatus. In some embodiments it is preferable that the heat treatment to shape the hydraulic hose does not change the pressures at which the hydraulic hose can operate significantly. The hydraulic hose may be hi-pressure nylon that is able to withstand 660 psi. In one embodiment the outer diameter (OD) of the hydraulic hose was ⅛" while the inner diameter (ID) was 0.073" and the wall thickness is 0.026". However, it will be appreciated by persons of skill in the art, that other hydraulic hoses could be substituted provided that the hose had specifications suitable for the present use.

The handle may be constructed wherein the first handle 12 is made of aluminum. In one embodiment (octagonal handle) the outer diameter (OD) was 0.89" while the inner diameter (ID) is 0.74" (both measured side to side) and the wall thickness is 0.08". The inside wall of the aluminum tube 12 may be dimensioned to fit a second handle 14, which is an octagonal aluminum tube. Both tubes (12 and 14) were approximately 30" long in some prototypes. The aluminum octagonal tube (second handle) is supported on the interior of the first handle tube by a plastic plug 15 which is dimensioned slightly smaller than the interior diameter (ID) of the first handle, to fit inside the interior of the first handle and allow for smooth movement of the first handle relative to the second handle. The plug has a hole which is dimensioned to allow a hydraulic hose to pass through the end of the plug from the interior of the second handle to the interior of the first handle. The first handle 12 in one embodiment does not have an octagonal inner wall, but has a way or guide (17 of FIGS. 6(*a*) and 6(*b*)) having a circular outer wall dimensioned to fit within the lock handle mount 100 and having an octagonal inner wall dimensioned to fit around the octagonal handle 14. This octagonal arrangement is beneficial as it prevents rotation of the first and second handles relative to one another and allows for the inline locking system (handle extension lock) to be aligned. However, alternative designs have been employed to achieve the similar results. For example, a prototype handle was also constructed wherein the first handle 12 was made of aluminum and had an outer diameter (OD) of 1.250", a wall thickness of 0.100" and having a hexagonal inner wall dimensioned to fit a second handle 14, which was a hexagonal aluminum tube measuring 1.030" point to point. Alternatively, a groove and projection system may be implemented to prevent rotation and maintain alignment.

The embodiments described herein are of particular use in the drywall taping and finishing trade. The handle apparatus described herein is useful in supporting over various distances and controlling the angle of a tool attached to one end of the handle. For example a tool such as a flat finishing box may be attached to the tool plate for use in coating flat joints between drywall boards. Alternatively, other tools may be attached to the tool plate or directly to a connector if an alternative connection system is implemented. For example, a flat finishing box, trowels for cement or plaster sanders, squeegees other drywall tools and other tools useful for working on potentially difficult to reach places where it may be advantageous to alter the angle of the tool relative to the handle.

While specific embodiments of the invention have been described and illustrated, such embodiments should be considered illustrative of the invention only and not as limiting the invention as construed in accordance with the accompanying claims.

What is claimed is:

1. An apparatus comprising:

a handle having a first end and a second end;

an actuator attached to the handle;

a connector attached to the second end of the handle;

a tool plate pivotally attached to the connector for receiving a tool;

a hydraulic hose; and a hydraulically actuated brake assembly communicating with the actuator by the hydraulic hose, wherein the brake assembly is operable to releasably hold the tool plate at a position relative to the connector and the handle on operation of the actuator, the brake assembly including:

a brake dial attached to the tool plate;

a hydraulic hose connector for attaching the hydraulic hose to the brake assembly;

a ram housing operably connected to the hydraulic hose connector;

a ram operably positioned within the ram housing, wherein the ram is pushed when the actuator is engaged; and a brake pin, engageable by the ram, whereby the brake pin engages the brake dial to prevent pivotal movement of the tool plate.

2. The apparatus of claim 1 wherein the handle and the hydraulic hose are extendable.

3. The apparatus of claim 2, wherein the apparatus further comprises an extension locking mechanism to releasably secure the handle at a selected length.

4. The apparatus of claim 2, wherein, the handle further comprises first and second telescoping portions.

5. The apparatus of claim 1, wherein the apparatus is dimensioned to support a flat finishing box.

6. The apparatus of claim 1, wherein the hydraulic hose is coiled and extends within an interior of the handle between the actuator and the hydraulically actuated brake assembly.

7. An apparatus comprising:

a handle having a first end and a second end;

an actuator attached to the first end of the handle;

a connector attached to the second end of the handle for pivotally connecting the handle to a tool;

a hydraulic hose; and a hydraulically actuated brake assembly communicating with the actuator by the hydraulic hose, wherein the brake assembly is operable to releasably hold the tool at a position relative to the connector and the handle on operation of the actuator and wherein the brake assembly comprises:

a brake dial, operable to be attached to the tool;

a hydraulic hose connector for attaching the hydraulic hose to the brake assembly;

a ram housing, operably connected to the hydraulic hose connector;

a ram, operably positioned within the ram housing, wherein the ram is pushed when the actuator is engaged; and a brake pin, engageable by the ram, whereby the brake pin engages the brake dial to prevent pivotal movement of the tool.

8. The apparatus of claim 7, wherein the handle and the hydraulic hose are extendable.

9. The apparatus of claim 8, wherein the apparatus further comprises an extension locking mechanism to releasably secure the handle at a desired length.

10. The apparatus of claim 8, wherein the handle further comprises first and second telescoping portions.

11. The apparatus of claim 7, wherein the apparatus is dimensioned to support a flat finishing box.

12. The apparatus of claim 7, wherein the hydraulic hose is coiled and extends within an interior of the handle between the actuator and the hydraulically actuated brake assembly.

13. An apparatus comprising:

a handle having a first end and a second end;

an actuator attached to the handle;

a connector attached to the second end of the handle;

a tool plate pivotally attached to the connector for receiving a tool;

a hydraulic hose; and a hydraulically actuated brake assembly communicating with the actuator by the hydraulic hose, wherein the brake assembly is operable to releasably hold the tool plate at a position relative to the connector and the handle on operation of the actuator, wherein the connector is configured to clamp the pivotal connection and wherein the brake assembly further comprises:

a hydraulic hose connector for attaching the hydraulic hose to the brake assembly;

a clamp ram housing, operably connected to the hydraulic hose connector; and a ram, operably positioned within the ram housing, wherein the ram engages the connector to increase friction between the connector and the pivotal attachment with the tool or tool plate to prevent pivotal movement of the tool or tool plate.

14. An apparatus comprising:

a handle having a first end and a second end;

an actuator attached to the first end of the handle;

a connector attached to the second end of the handle for pivotally connecting the handle to a tool;

a hydraulic hose; and a hydraulically actuated brake assembly communicating with the actuator by the hydraulic hose, wherein the brake assembly is operable to releasably hold the tool at a position relative to the connector and the handle on operation of the actuator, wherein the connector is configured to clamp the pivotal connection and wherein the brake assembly further comprises:

a hydraulic hose connector for attaching the hydraulic hose to the brake assembly;

a clamp ram housing, operably connected to the hydraulic hose connector; and a ram, operably positioned within the ram housing, wherein the ram engages the connector to increase friction between the connector and the pivotal attachment with the tool or tool plate to prevent pivotal movement of the tool or tool plate.

* * * * *

UNITED STATES PATENT AND TRADEMARK OFFICE

CERTIFICATE OF CORRECTION

PATENT NO. : 7,631,389 B2
APPLICATION NO. : 11/075831
DATED : December 15, 2009
INVENTOR(S) : St. James et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1317 days.

Signed and Sealed this

Twenty-first Day of December, 2010

David J. Kappos

David J. Kappos
*Director of the United States Patent and Trademark Office*